US012104830B2

(12) United States Patent
Taras

(10) Patent No.: US 12,104,830 B2
(45) Date of Patent: Oct. 1, 2024

(54) THERMAL ENERGY RESERVOIRS AND HEAT PUMP SYSTEMS

(71) Applicant: Daikin Comfort Technologies Manufacturing, L.P., Waller, TX (US)

(72) Inventor: Michael F. Taras, The Woodlands, TX (US)

(73) Assignee: Daikin Comfort Technologies Manufacturing, L.P., Waller, TX (US)

( * ) Notice: Subject to any disclaimer, the term of this patent is extended or adjusted under 35 U.S.C. 154(b) by 0 days.

(21) Appl. No.: 17/823,154

(22) Filed: Aug. 30, 2022

(65) Prior Publication Data

US 2024/0068714 A1 Feb. 29, 2024

(51) Int. Cl.
*F25B 49/02* (2006.01)
*F24F 5/00* (2006.01)
(Continued)

(52) U.S. Cl.
CPC ..... *F25B 30/02* (2013.01); *F24F 5/0017* (2013.01); *F25B 47/022* (2013.01); *F25B 49/02* (2013.01); *F24F 2005/0025* (2013.01); *F25B 2400/24* (2013.01); *F25B 2500/09* (2013.01); *F25B 2600/2501* (2013.01); *F25B 2600/2515* (2013.01); *F25B 2700/11* (2013.01); *F25B 2700/2104* (2013.01); *F25B 2700/2111* (2013.01)

(58) Field of Classification Search
CPC . F24F 5/0017; F24F 2005/0025; F25B 30/02; F25B 47/022; F25B 2400/24; F25B 2600/2501; F25B 2600/2515; F25B 2700/2104
See application file for complete search history.

(56) References Cited

U.S. PATENT DOCUMENTS 4,693,089 A 9/1987 Bourne et al.
5,680,898 A * 10/1997 Rafalovich ..... F25B 13/00 165/236
2011/0214444 A1* 9/2011 Yoshii ..... F25B 47/006 62/160

FOREIGN PATENT DOCUMENTS

CN 104457026 A 3/2015
KR 100944312 B1 2/2010
(Continued)

OTHER PUBLICATIONS

International Search Report and Written Opinion dated Nov. 2, 2023 for corresponding PCT Patent Application No. PCT/US2023/070719 filed on Jul. 21, 2023.

*Primary Examiner* — Jonathan Bradford
(74) *Attorney, Agent, or Firm* — K&L Gates LLP

(57) ABSTRACT

A heating, ventilation, and air conditioning (HVAC) system and controller therefor to operate with thermal energy reservoirs is provided to set a four-way valve to route a refrigerant through a refrigerant circuit in a first direction when the HVAC system is set to a cooling mode or in a second direction, opposite to the first direction, when the HVAC system is set to a heating mode; and set bypass valves in the refrigerant circuit based on a temperature of a temperature holding material in a thermal energy reservoir and which of the heating mode and the cooling mode the four-way valve is set to, wherein the bypass valves route the refrigerant through the thermal energy reservoir to transfer thermal energy between the refrigerant and the temperature holding material.

20 Claims, 9 Drawing Sheets

(51) Int. Cl.
*F25B 30/02* (2006.01)
*F25B 47/02* (2006.01)

(56) References Cited

FOREIGN PATENT DOCUMENTS

KR 10-20100030204 A 3/2010
KR 101060511 B1 8/2011

* cited by examiner

THERMAL ENERGY RESERVOIRS AND HEAT PUMP SYSTEMS

BACKGROUND

This section is intended to introduce the reader to various aspects of the art that may be related to various aspects of the presently described embodiments to help facilitate a better understanding of various aspects of the present embodiments. Accordingly, it should be understood that these statements are to be read in this light, and not as admissions of prior art.

A heat pump is a refrigerant system that is typically operable in both cooling and heating modes. While air conditioners are familiar examples of heat pumps, the term "heat pump" is more general and applies to many heating, ventilating, and air conditioning ("HVAC") devices used for space heating or space cooling.

In a cooling mode, a heat pump operates like a typical air conditioner, i.e., a refrigerant is compressed in a compressor and delivered to a condenser (or an outdoor heat exchanger). In the condenser, heat is exchanged between a media, such as outdoor air, and the refrigerant. From the condenser, the refrigerant passes to an expansion device, which expands the refrigerant to a lower pressure and temperature, and then to an evaporator (or an indoor heat exchanger). In the evaporator, heat is exchanged between the refrigerant and the indoor air, to condition the indoor air. When the refrigerant system is operating, the evaporator cools the air that is being supplied to the indoor environment. In addition, as the temperature of the indoor air is lowered, moisture usually is also taken out of the air. In this manner, the humidity level of the indoor air can also be controlled.

When a heat pump is used for heating, it employs the same basic refrigeration-type cycle used by an air conditioner or a refrigerator, but in the opposite direction. That is, heat is released into the conditioned space rather than the surrounding environment. In this use, heat pumps generally draw heat from cooler external air or from the ground.

Reversible heat pumps (generally referred to herein simply as "heat pumps") work in either direction to provide heating or cooling to the internal space as mentioned above. Reversible heat pumps employ a reversing valve to reverse the flow of refrigerant from the compressor through the condenser and evaporation coils. In the heating mode, the outdoor coil is an evaporator, while the indoor coil is a condenser. The refrigerant flowing from the evaporator (outdoor coil) carries the thermal energy from outdoor air (or other source such as soil) indoors. Vapor temperature is augmented within the heat pump by compressing the refrigerant. The indoor coil then transfers thermal energy from the refrigerant (including energy from the compression) to the indoor air, which is then moved around the inside of the building by an air handler. The refrigerant is then allowed to expand, cool, and absorb heat from the outdoor temperature in the outdoor evaporator, and the cycle repeats. This is a standard refrigeration cycle, save that the "cold" side of the refrigerator (the evaporator coil) is positioned so it is outdoors where the environment is colder.

When operating in the heating mode, thermal energy is provided to the conditioned environment (e.g., internal occupant spaces within a building), and thus the outdoor ambient temperatures are relatively cold when the outdoor evaporator is on the "cold" side of the refrigeration cycle. The combination of cold outdoor ambient temperatures and cold refrigerant within the outdoor evaporator can result in ice formation on the outdoor evaporator. The ice formation may be removed by "defrosting" the outdoor evaporator, to protect the compressor and to maintain the efficiency of heat transfer between the refrigeration system and the outdoor environment. One solution for defrosting the outdoor heat exchanger is to reverse the flow of the refrigerant in the refrigeration cycle so that the outdoor heat exchanger acts as the condenser and the indoor heat exchanger acts as the evaporator. By reversing the refrigerant flow in this manner, the outdoor heat exchanger is placed on the "hot" side of the refrigeration cycle and any ice formation of the outdoor heat exchanger is melted. However, this method of defrosting places the refrigeration system into a cooling mode for the conditioned environment, which is not desirable when experiencing colder outdoor ambient temperatures.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to HVAC system designs that allow for the selective inclusion of thermal energy reservoirs into a refrigerant circuit. Advantageously, certain disclosed embodiments provide for increased operational capacity of the HVAC system, thereby allowing the improved HVAC system to provide greater heating ability on colder days and greater cooling ability on hotter days than other HVAC systems not employing the design described herein. Advantageously, certain disclosed embodiments provide for increased operational efficiency of the HVAC system, thereby allowing the improved HVAC system to provide heating and cooling at a greater satisfaction level to end users when dealing with less reliable energy supplies than other HVAC systems not employing the design described herein. Advantageously, certain disclosed embodiments provide for increased operational reliability of the HVAC system, thereby allowing the improved HVAC system to provide heating and cooling to end users when defrosting a heat exchanger while other HVAC systems not employing the design described herein may be incapable or less efficient of similar operational defrosting. Other advantages of the design described herein will be apparent to those of skill in the relevant art on reading the present disclosure.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION

One or more specific embodiments of the present disclosure are described herein. In an effort to provide a concise description of these embodiments, not all features of an actual implementation may be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

The present disclosure relates to heat pump heating, ventilating, and air conditioning ("heat pump HVAC", or more simply referred to herein as "HVAC") systems, and more particularly to systems and methods for employing thermal energy reservoirs to aid in the heating and cooling of a designated environment. Additionally, the HVAC systems can use the thermal energy reservoirs to aid in defrosting the condensers, and to provide heat for other useful tasks. Although defrosting is described, it should also be appreciated that systems and methods can also be used to prevent frost or ice formation before accumulation.

Figure 1A:
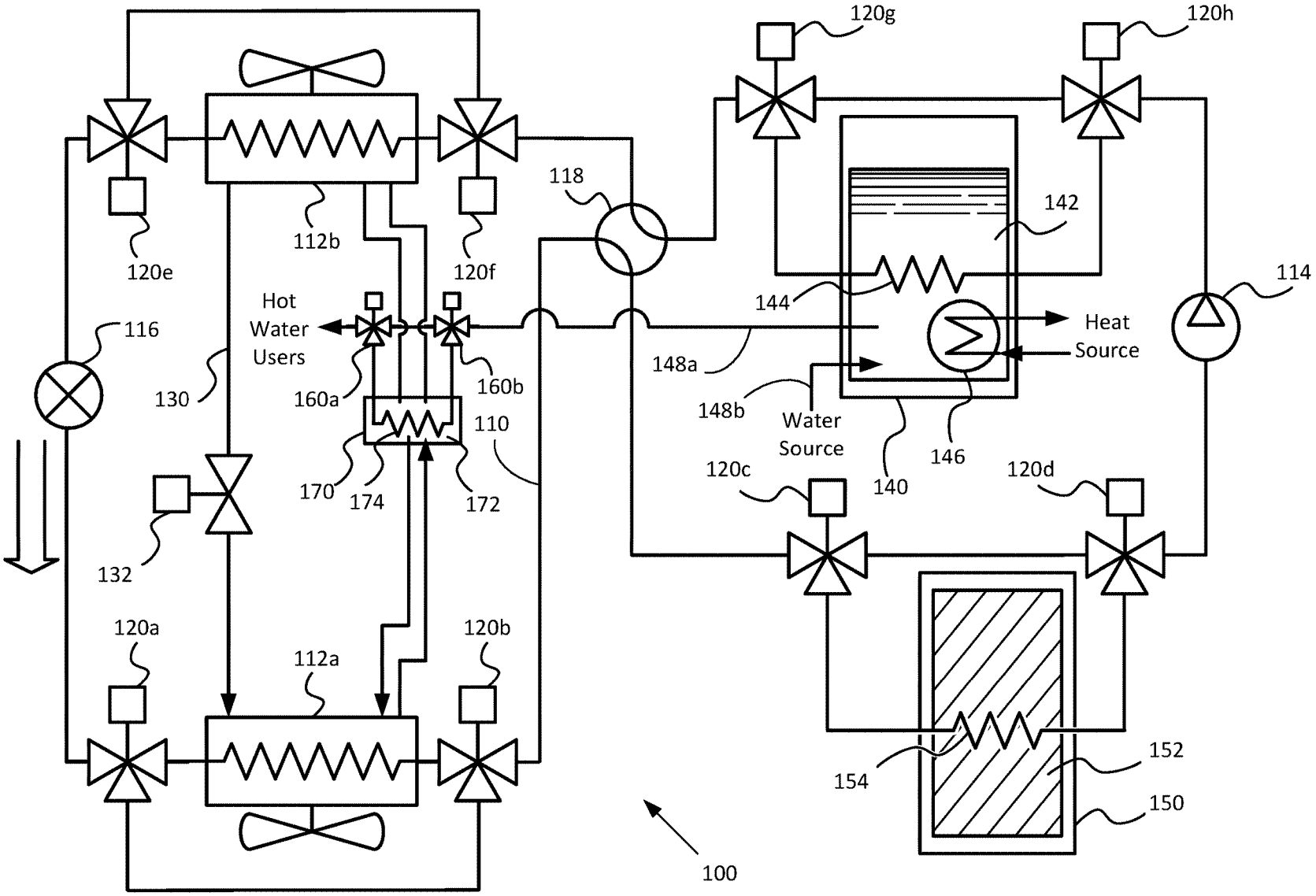
FIGS. 1A and 1B provide a schematic of a Heating Ventilation and Air Conditioning (HVAC) system including thermal energy reservoirs, according to embodiments of the present disclosure.
Figure 1B:
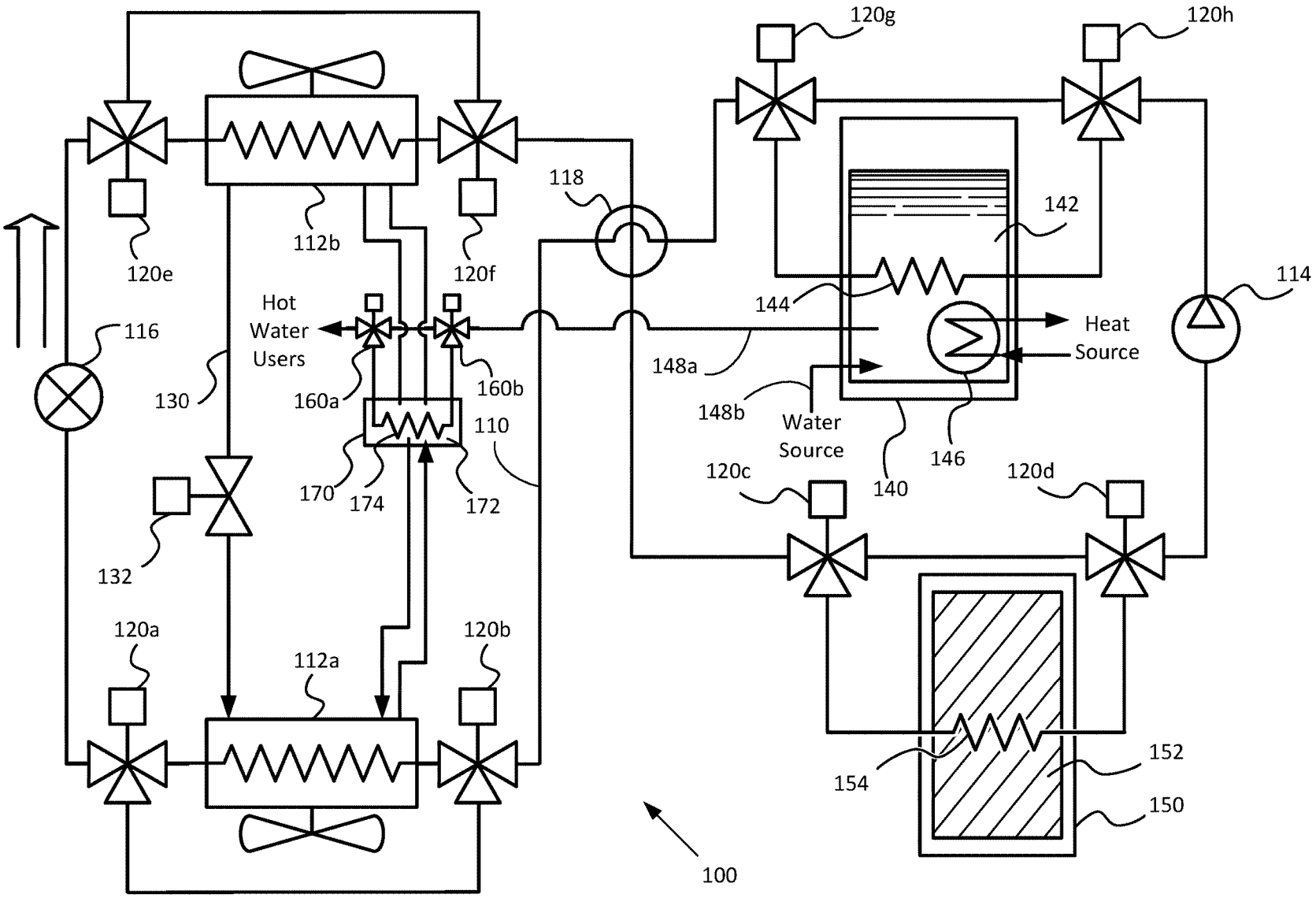

FIGS. 1A and 1B provide a schematic of an HVAC system 100 including thermal energy reservoirs 140, 150, according to embodiments of the present disclosure. The HVAC system 100 includes a refrigerant circuit 110 that includes a first heat exchanger 112*a* located in or in communication with a conditioned environment (e.g., an indoor heat exchanger of the HVAC system 100, such as an indoor heat exchanger 112*a*), a second heat exchanger 112*b* located in or in communication with a non-conditioned environment (e.g., an outdoor heat exchanger of the HVAC system 100 in an non-conditioned (e.g., outdoor) environment to expel heat from X to Y when the HVAC system 100 is in a cooling mode or draw heat from X to Y when the HVAC system 100 is in a heating mode, such as an outdoor heat exchanger 112*b*), a compressor 114, an expansion device 116, and a four-way valve 118. The indoor heat exchanger 112*a* and the outdoor heat exchanger 112*b* may generally or collectively be referred to as heat exchangers 112. Further, the four-way valve 118 may route a refrigerant carried by the refrigerant circuit 110 in a first direction while in the cooling mode (as shown in FIG. 1A) and in a second direction, opposite to the first direction, while in the heating mode (as shown in FIG. 1B). In various embodiments, the heat exchangers 112 may be associated with fans of various types (e.g., fixed speed, two speed, variable speed, etc.) to move air across the heat exchangers 112. Although not illustrated, the HVAC system 100 may include additional components, such as accumulators, receivers, charge compensators, flow control devices, air movers, pumps, filters, guards, filter driers, air ducts, and the like.

When in a cooling mode of operation or a heating mode of operation, a refrigerant circulates through the refrigerant circuit 110 to perform a vapor compression refrigeration cycle, whereby heat is exchanged with a non-conditioned environment at the second heat exchanger 112*b* and with the conditioned environment at the first heat exchanger 112*a* to cool or heat the conditioned environment to a desired temperature.

In addition to the conditioned environment and the non-conditioned environment, the HVAC system 100 can also heat or cool (by expelling thermal energy to or extracting thermal energy from) one or more thermal energy reservoirs, such as a hot water tank 140 or a thermal storage tank 150. Although illustrated with two heat exchangers 112 and two thermal energy reservoirs, in various embodiments, an HVAC system 100 may include one or more heat exchangers 112 located in the conditioned environment, one or more heat exchangers 112 located in the non-conditioned environment, and one or more thermal energy reservoirs (e.g., zero, one, or multiple hot water tanks 140 and zero, one, or multiple thermal storage tanks 150) and combinations thereof that are selectively connectable to the refrigerant circuit 110.

Concurrently with the refrigeration cycle described herein, air is circulated in a cycle between the first heat exchanger 112*a* and the conditioned environment, such that thermal energy from the refrigeration cycle is exchanged with the conditioned environment.

In the cooling mode of FIG. 1A, the compressor 114 compresses the refrigerant. The refrigerant flows to the second heat exchanger 112*b*. The refrigerant dissipates heat to ambient air in the non-conditioned environment at the second heat exchanger 112*b*. The refrigerant flows to the expansion device 116. In various embodiments, the expansion device 116 includes a bi-flow expansion device or two sets of two unidirectional expansion devices complemented by internal or external check valves and bypass lines. The expansion device 116 expands the refrigerant to reduce the pressure and temperature thereof. The refrigerant then flows to the first heat exchanger 112*a*. The refrigerant, having a reduced temperature and a reduced pressure from the expansion device 116, exchanges heat at the first heat exchanger 112*a*. That is, the refrigerant absorbs heat from the air in the conditioned environment at the first heat exchanger 112*a*. Thus, in a cooling mode, the first heat exchanger 112*a* operates as an evaporator. The cooled air from the first heat exchanger 112*a* is supplied to the conditioned environment by various ducts and blowers. After the heat exchange at the first heat exchanger 112*a*, the refrigerant is evaporated into a gaseous state in the expansion device 116. and the refrigerant then travels through the four-way valve 118 and is sucked into the compressor 114 to repeat the cycle.

In a heating mode shown in FIG. 1B, the refrigerant is compressed by the compressor 114 and is sent through the four-way valve 118 to the first heat exchanger 112*a*. The refrigerant dissipates heat to air from the conditioned environment at the first heat exchanger 112*a* then travels to the expansion device 116. At the expansion device 116, the refrigerant expands to reduce the pressure and temperature of the refrigerant. The refrigerant then flows to the second heat exchanger 112*b*. The low temperature and low pressure refrigerant from the expansion device 116 exchanges heat at the second heat exchanger 112*b*. That is, the refrigerant absorbs heat from the ambient air in the non-conditioned environment. Thus, in a heating mode, the second heat exchanger 112*b* operates as an evaporator. After the heat exchange at the second heat exchanger 112*b*, the refrigerant is evaporated into a gaseous state in the expansion device 116 and then travels back through the four-way valve 118. The refrigerant is then sucked into the compressor 114 to repeat the cycle.

The equipment of the refrigerant circuit 110 and flow of the refrigerant through the circuit may be controlled by a main controller (e.g., such as controller 600 discussed with respect to FIG. 6) that controls the HVAC system 100. The main controller may be configured to communicate with a remote controller. A user can send, for example, a set values of temperatures of rooms in the conditioned environment to the main controller from the remote controller. For controlling the HVAC system 100, a plurality of temperature sensors to measure the temperature of the refrigerant in various portions of the refrigerant circuit 110, a plurality of pressure sensors to measure the pressure of each portion, and/or temperature sensors for measuring air temperatures (e.g., such as a supply air temperature sensor) within the supply ducts and/or the return ducts may be used.

The main controller may perform at least on/off control of the compressor 114 the fans, and the blowers used to move air across the heat exchangers 112 or in the environments. In addition, when motors within the system are variable speed motors (e.g., motor(s) for the compressor 114, fans, and blowers), the controller may be configured to individually control the speed of each motor. In this manner, the rate of heat exchange of the HVAC system 100 may be controlled by controlling the blower motor rotational speed, thereby controlling the flow rate of the blower airflow across the heat exchangers 112. Similarly, the rate of heat exchange of the HVAC system 100 may be controlled by controlling the compressor 114 motor, thereby controlling the flowrate of refrigerant in the refrigerant circuit 110.

In some embodiments, the expansion device 116 may be a thermal expansion valve (TXV), an electronic expansion valve (EXV), or a fixed-orifice expansion device. When the expansion device 116 is a TXV, the TXV is controlled using a temperature sensing bulb and an equalizer line (not shown) that may be connected to the refrigerant circuit at a position downstream of the TXV. The temperature sensing bulb may be placed on a compressor suction line upstream from the compressor 114 and downstream of the four-way valve 118, with respect to the refrigerant flow. If an accumulator is used, the bulb may be placed in the compressor suction line upstream or downstream of the accumulator, with respect to the refrigerant flow. In this manner, the output of the sensing bulb is adjusted to account for the amount of liquid refrigerant within the accumulator. The location of the sensing bulb may be selected to optimize vapor compression refrigeration cycle, depending on user preferences for the HVAC system 100. Additionally, the HVAC system 100 may include an equalization line (not shown) in communication with the pressures in the heat exchangers 112. In the cooling mode for example, the first heat exchanger 112*a* is the evaporator and the pressure of the refrigerant leaving the first heat exchanger 112*a* is communicated to the TXV through the equalizer line. Pressure communicated through the equalizer line may be used to balance the pressure communicated to the expansion device 116 from the sensing bulb to operate the TXV. The TXV may be set to maintain a compressor superheat level while optimizing whichever of the indoor heat exchanger or outdoor heat exchanger is operating as the evaporator. Controlling the TXV with this method allows the evaporator superheat level to be maintained at more efficient levels. Further, the expansion device 116 may include an internal bleed port to maintain a more accurate and stable control, as well as equalize the high side pressure and low side pressure during the off-cycle. Further, the TXV may also be a so-called balanced port design with the pressure of the refrigerant at the condenser balanced across the valve.

In embodiments that include an accumulator in the compressor suction line (e.g., a line upstream from the compressor 114), the accumulator allows for the collection of some refrigerant, before the refrigerant flows to the compressor 114. This provides the benefit of separating some non-vaporized refrigerant before passing to the compressor 114. Further, the expansion device 116 is also configurable to control the flow of refrigerant to store some refrigerant in an accumulator if there is a refrigerant charge imbalance in the refrigerant circuit. In doing so, the expansion device 116 may be configured to lower a superheat level of the evaporator, which in the cooling mode is the first heat exchanger 112*a*, compared to not including the accumulator in the HVAC system 100. This allows an evaporator with a lesser peak heating/cooling capacity to be used for the load of the HVAC system 100. As an example, the expansion device 116 is configurable to control flow of the refrigerant through the evaporator such that a superheat level of the evaporator is as close to zero as possible while maintaining a superheat level control at the compressor 114.

Figure 6:
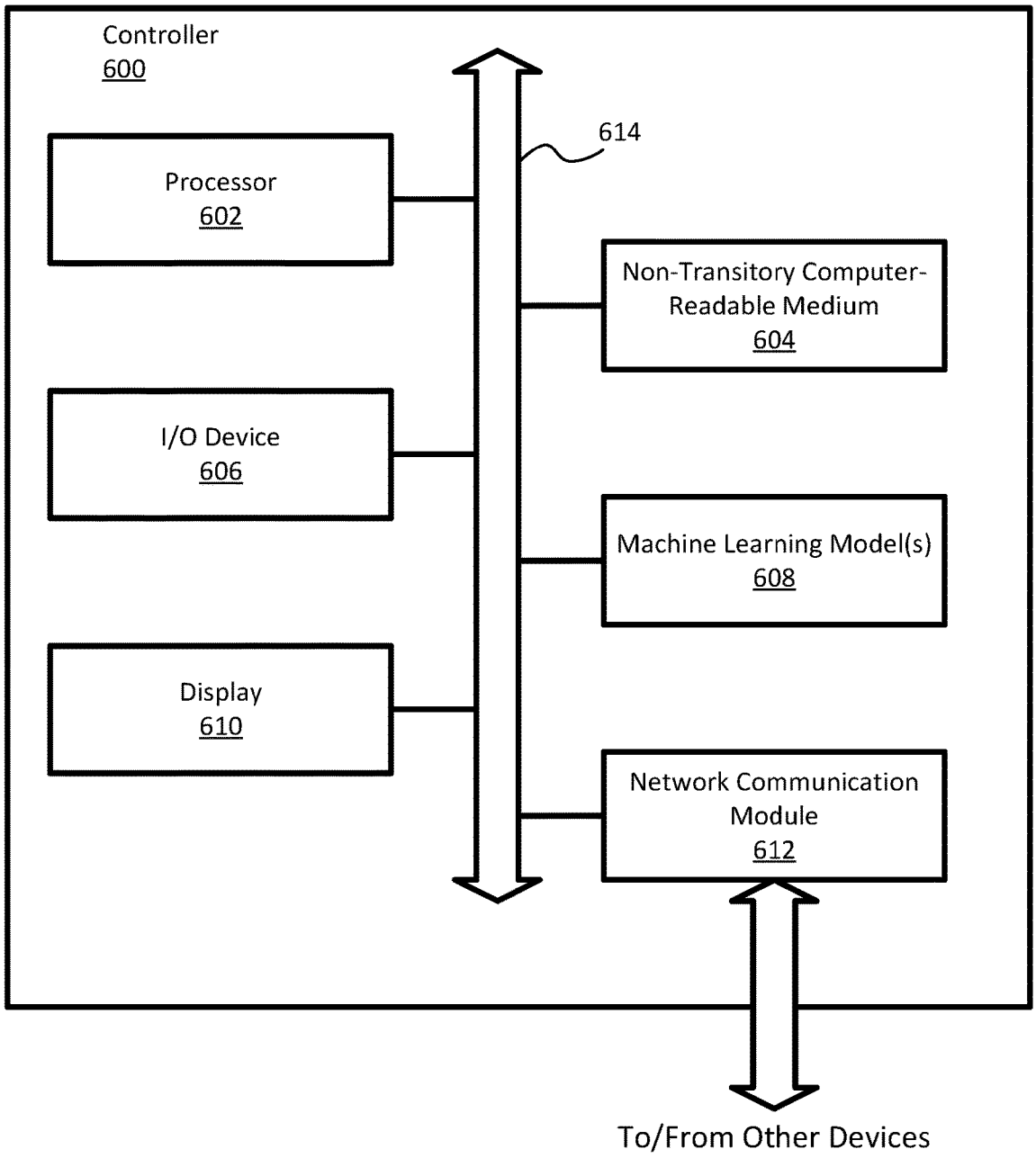
FIG. 6 illustrates a computing device, as may be used as a controller for an HVAC system including thermal energy reservoirs, according to embodiments of the present disclosure.

Alternatively, in some embodiments, the expansion device 116 may be an electronic expansion valve ("EXV"), and a pair of temperature or temperature/pressure sensors (not shown) may be connected to a main controller (such as controller 600 discussed in greater detail in regard to FIG. 6) to provide measurement data for the control of the EXV bi-flow expansion device 116 operation. The temperature and/or pressure sensors are positioned to sense temperature and/or pressure in the compressor suction line and/or the accumulator upstream of the compressor 114 and downstream of the four-way valve 118. The main controller processes the measurement data and provides control commands to the EXV expansion device 116 to operate the HVAC system 100 similarly to the TXV operation discussed above.

In addition to or alternatively to operating the heat exchangers 112 as outlined to heat or cool the conditioned environment by exchanging heat with the non-conditioned environment, the HVAC system 100 also exchanges heat with various thermal reservoirs (via associated heat exchangers) to thereby improve the efficiency or reliability of the HVAC system 100. The controller (600) routes the refrigerant to or around one or more of the heat exchangers 112 and thermal energy reservoirs to direct the flow of refrigerant to cool or heat the conditioned environment and/or thermal storage media (e.g., thermal media 152 or water 142) located within the thermal energy reservoirs.

In addition to the components described above, the HVAC system 100 includes various bypass valves 120*a-h* (generally or collectively, bypass valve 120) that operate to route the refrigerant to or around various components of the HVAC system 100. For example, a first bypass valve 120*a* and a second bypass valve 120*b* can route the refrigerant through or bypass the first heat exchanger 112*a*, and a fifth bypass valve 120*e* and a sixth bypass valve 120*f* can route the refrigerant through or bypass the second heat exchanger 112*b*, allowing the other heat exchanger 112 to continue operating, but for a heating or cooling effect to instead be directed to the thermal energy reservoirs. Similarly, a third bypass valve 120*c* and a fourth bypass valve 120*d* can route the refrigerant through or bypass the thermal storage tank 150, and a seventh bypass valve 120*g* and an eighth bypass valve 120*h* can route the refrigerant through or bypass the hot water tank 140. The refrigerant circuit 110 thereby is in selective fluid communication with the various indoor heat exchangers 112, outdoor heat exchangers 112, and thermal energy reservoirs, and may connect or disconnect fluid communication to one or more of the described elements via the associated bypass valves 120. In various embodiments, the bypass valves 120 can be on/off bypass valves or modulating bypass valves. Furthermore, the bypass valves 120 controlling the refrigerant flow through or around the thermal reservoirs 140/150 can be substituted by pairs of a bypass valve and a check valve (in some cases, for simplicity, the check valves may be eliminated).

As described herein, the refrigerant may be routed through the thermal energy reservoirs in one of two modes: a charging mode, where the initial temperature of the refrigerant is used to bring thermal storage media in the reservoirs to a desired temperature, and a discharging mode, where the initial temperature of the thermal storage media is used to bring the refrigerant or a secondary media to a desired temperature. In various embodiments, charging may include imparting thermal energy to the thermal storage media or extracting thermal energy from the thermal storage media; heating or cooling the media respectively. Similarly, discharging may include imparting thermal energy to the thermal storage media or extracting thermal energy from the thermal storage media; heating or cooling the refrigerant respectively. Charging and discharging modes may operate independently from or in conjunction with the heating/cooling mode of the conditioned environment.

When not in the charging mode or the discharging mode, such as when the refrigerant is routed to bypass the reservoir heat exchanger (144/154) in the corresponding thermal energy reservoir (140/150), the thermal energy reservoir may be considered to be in a holding mode. Accordingly, a first set of bypass valves 120 may be configured to selectively route the refrigerant carried via the refrigerant circuit 110 through a thermal storage tank heat exchanger 154 to exchange heat with the thermal media 152 in a coolant charging mode or a coolant discharging mode, or to bypass the thermal storage tank heat exchanger 154 in a coolant holding mode. Similarly, another set of bypass valves 120 may be configured to selectively route the refrigerant through a water tank heat exchanger 144 to exchange heat with the water 142 in a heater charging mode or a heater discharging mode, or to bypass the water tank heat exchanger 154 in a heater holding mode.

In various embodiments, the controller is operable to selectively control the flow refrigerant through the thermal energy reservoirs (e.g., to place the thermal energy reservoir in one of the charging or discharging modes) or to selectively bypass the thermal energy reservoirs (e.g., to place the thermal energy reservoir into the holding mode) based on various operational criteria in the HVAC system 100. In some embodiments, the controller uses a historic heating/cooling demand curve and/or weather forecasts to identify when the HVAC system 100 is most active, and may charge the thermal energy reservoirs in anticipation of high-use times. Additionally, the HVAC system 100 may monitor the temperatures of temperature holding materials in the thermal energy reservoirs and temperatures of the conditioned and un-conditioned environment (including an icing status of the cold heat exchanger) to assess when to use the thermal energy reservoirs in the charging, discharging, or hold modes. Additionally or alternatively, the controller may use live data or historic data regarding energy availability characteristics (e.g., power availability fluctuations, set rates, availability of renewable power sources, etc.) to determine when to use the thermal energy reservoirs in the charging, discharging, or hold modes.

The hot water tank 140 may include various models of insulated water tanks for the storage, heating, and distribution of hot water 142 as thermal storage media. The water 142 included in the tank may be received from various water sources, and distributed to various hot water users via an outflow line 148*a*. A water tank heat exchanger 144 is disposed in the path between the seventh bypass valve 120*g* and the eighth bypass valve 120*h*. In a cooling mode, heat extracted from the conditioned environment can be sunk to the water 142, thereby heating the water 142 in the hot water tank 140 in addition to or instead of expelling heat to the non-conditioned environment via the second heat exchanger 112*b*. In a heating mode, heat extracted from the non-conditioned environment can be sunk to the water 142, thereby heating the water 142 in the hot water tank 140 in addition to or instead of warming the conditioned environment via the first heat exchanger 112*a*. In addition to or instead of a water tank heat exchanger 144 located within the hot water tank 140, the water tank heat exchanger 144 may be located in or surrounding an intake pipe or inflow line 148*b* to preheat water 142 flowing into the hot water tank 140 from a water source.

In various embodiments, the water tank heat exchanger 144 may be supplemented by an auxiliary heat exchanger 146 to heat the water 142 when the thermal energy from the environment is not available or insufficient to heat the water 142 to a desired temperature. In various embodiments, the heat source for the auxiliary heat exchanger 146 may be an electrical power supply or a fuel supply (e.g., natural gas, oil, diesel, etc.).

The hot water tank 140 includes an outflow line 148*a* to supply various users with hot water 142, and an inflow line 148*b* to receive additional water 142 (e.g., to replace water supplied to the users). In various embodiments, a first hot water valve 160*a* and a second hot water valve 160*b* (generally or collectively, hot water valves 160) are provided to regulate the supply of hot water 142 from the hot water tank 140, and to route the hot water 142 to various users, either directly or via a defroster 170. The defroster 170 may include various antifreeze materials 172, such as ethylene glycol or propylene glycol, that the hot water 142 imparts thermal energy to via a defroster heat exchanger 174 when the hot water valves 160 route the hot water 142 through the defroster 170. When ice (or conditions favorable to ice formation) is detected on the heat exchangers 112, the heated antifreeze material 172 is routed to heat the cold heat exchanger 112 for use in a deicing operation or a frost prevention operation to remove or prevent the formation of ice on heat exchange elements of the heat exchangers 112.

In addition to or instead of using the hot water 142 from the outflow line 148*a*, the HVAC system 100 further includes a defrost duct 130 connected between heat exchangers 112 that provides a second loop or circuit to use the heated air from one heat exchanger 112 to increase the localized air temperature to be above freezing to prevent the formation or removal already-formed ice at the other heat exchanger 112. A defrost damper valve 132 may allow the flow of hot air from one heat exchanger 112 to the other, and may regulate the amount of hot air that flows between the heat exchangers 112. The use of one or more of the hot water 142 or the hot air to locally heat to prevent or remove ice from the evaporator may be performed in addition to or instead of reversing the refrigeration cycle and using the refrigerant to melt (or preemptively heat) ice, as reversing the refrigeration cycles is generally not desirable with regards to the continued cooling or heating of the conditioned environment. The defrost damper valve 132 and the water distribution valve 160 may collectively be referred to as defrost valves, and are controlled (e.g., via a controller 600 as discussed in greater detail in regard to FIG. 6) to direct a warming media to the cold heat exchanger 112 to prevent ice formation conditions or remove ice from the heat exchanging surfaces by locally increasing the temperature of those heat exchanging surfaces, which may be performed while the HVAC system 100 continues operating in the heating or cooling mode that resulted in the ice formation conditions.

In various embodiments, the hot water tank 140 may be treated as a "heat source" that the HVAC system 100 charges with thermal energy when operating in the heating mode, and discharges to provide supplemental heat from the thermal energy stored in the hot water 142 into the conditioned environment when the second heat exchanger 112*b* is inoperable (e.g., during a defrost operation) or has insufficient capacity to heat the conditioned environment to the desired temperature in a given period of time. Additionally or alternatively, the HVAC system 100 may discharge thermal energy from the hot water 142 as a substitute for heating the refrigerant in the non-conditioned environment via the second heat exchanger 112*b* (e.g., when energy supply conditions make the discharge of thermal energy more efficient than running the second heat exchanger 112*b*). Additionally or alternatively, the HVAC system 100 may charge the hot water tank 140 with thermal energy collected from the conditioned environment by the first heat exchanger 112*a* when operating in a cooling mode rather than or in addition to expelling heat to the non-conditioned environment.

The thermal storage tank 150 may include various models of insulated tanks for the storage and cooling of a thermal media 152 as thermal storage media. The thermal media 152 in the thermal storage tank 150 may include various compounds such as water solutions containing Glauber salt, NaCl, KCl and other mixture of ingredients of appropriate concentrations that the refrigerant chills (or is used to chill the refrigerant) when passed through a thermal storage tank heat exchanger 154. In various embodiments, the thermal media 152 may be a liquid that changes phase to a slurry or solid when cooled by the refrigerant, or a gas that changes phase to a liquid when cooled by the refrigerant (e.g., a phase change media). The cooled refrigerant may be passed through the thermal media 152 to extract thermal energy from the thermal media 152 (e.g., to precool or "charge" the thermal media 152) when operated in a cooling mode to later supplement the cooling provided by the second heat exchanger 112*b* by "discharging" the thermal media 152 to further cool the refrigerant or directly cooling the air provided to the conditioned space. Accordingly, the thermal media 152 allows the cooling capacity of the refrigerant to be "stored" for later use when the heat exchangers 112 would not be capable of cooling the conditioned environment to a desired temperature (e.g., due to operational capacity of the heat exchangers 112, energy supply constraints, ice formation on the heat exchangers 112, or the like).

A thermal storage tank heat exchanger 154 is disposed in the path between the third bypass valve 120*c* and the fourth bypass valve 120*d* so that heat can be extracted from the refrigerant by the thermal media 152 in addition to or instead of cooling the refrigerant with the heat exchangers 112 (e.g., to discharge the thermal media 152) or so that the refrigerant or the conditioned space air can extract heat from the thermal media 152 (e.g., to charge the thermal media 152). Although illustrated as a sealed system, in various embodiments, the thermal storage tank 150 may include lines to drain or refill the thermal media 152 (e.g., for servicing and installation). Additionally, although not illustrated, both the hot water tank 140 and the thermal storage tank 150 may include various pressure release valves and other safety devices.

In various embodiments, the thermal storage tank 150 may be treated as a "cold source" that the HVAC system 100 charges by removing thermal energy from the thermal media 152 when operating in the cooling mode, and discharges to provide supplemental cooling to the refrigerant or conditioned space air to cool the conditioned environment when the first heat exchanger 112*a* is inoperable (e.g., during a defrost operation) or has insufficient capacity to cool the conditioned environment to the desired temperature in a given period of time. Additionally or alternatively, the HVAC system 100 may charge the thermal media 152 as a substitute for cooling the conditioned environment via the second heat exchanger 112*b* (e.g., when energy supply conditions make the precooling of the thermal media 152 for later cooling of the conditioned environment advantageous).

Figure 2A:
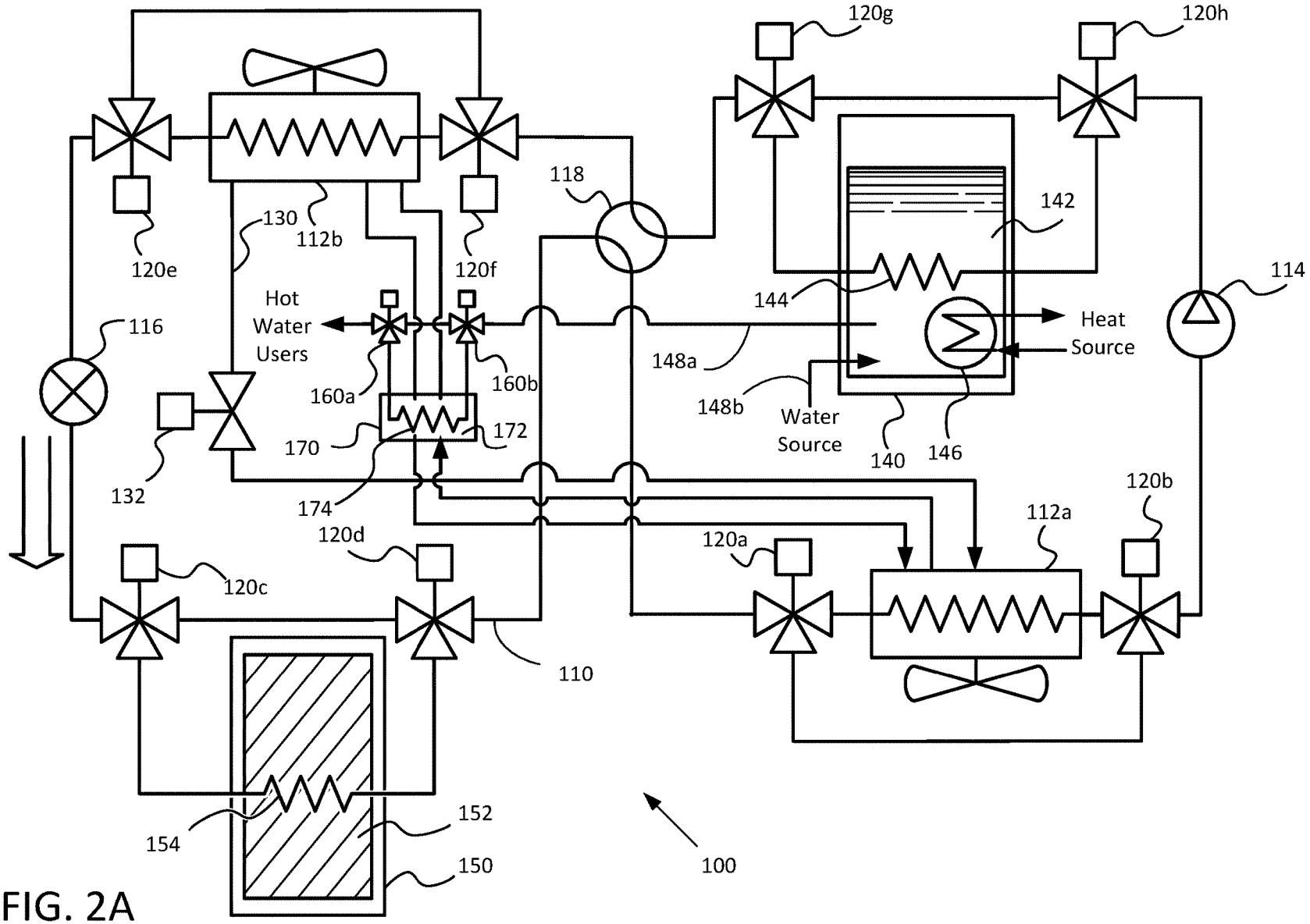
FIGS. 2A and 2B provide a schematic of an HVAC system including thermal energy reservoirs, according to embodiments of the present disclosure.
Figure 2B:
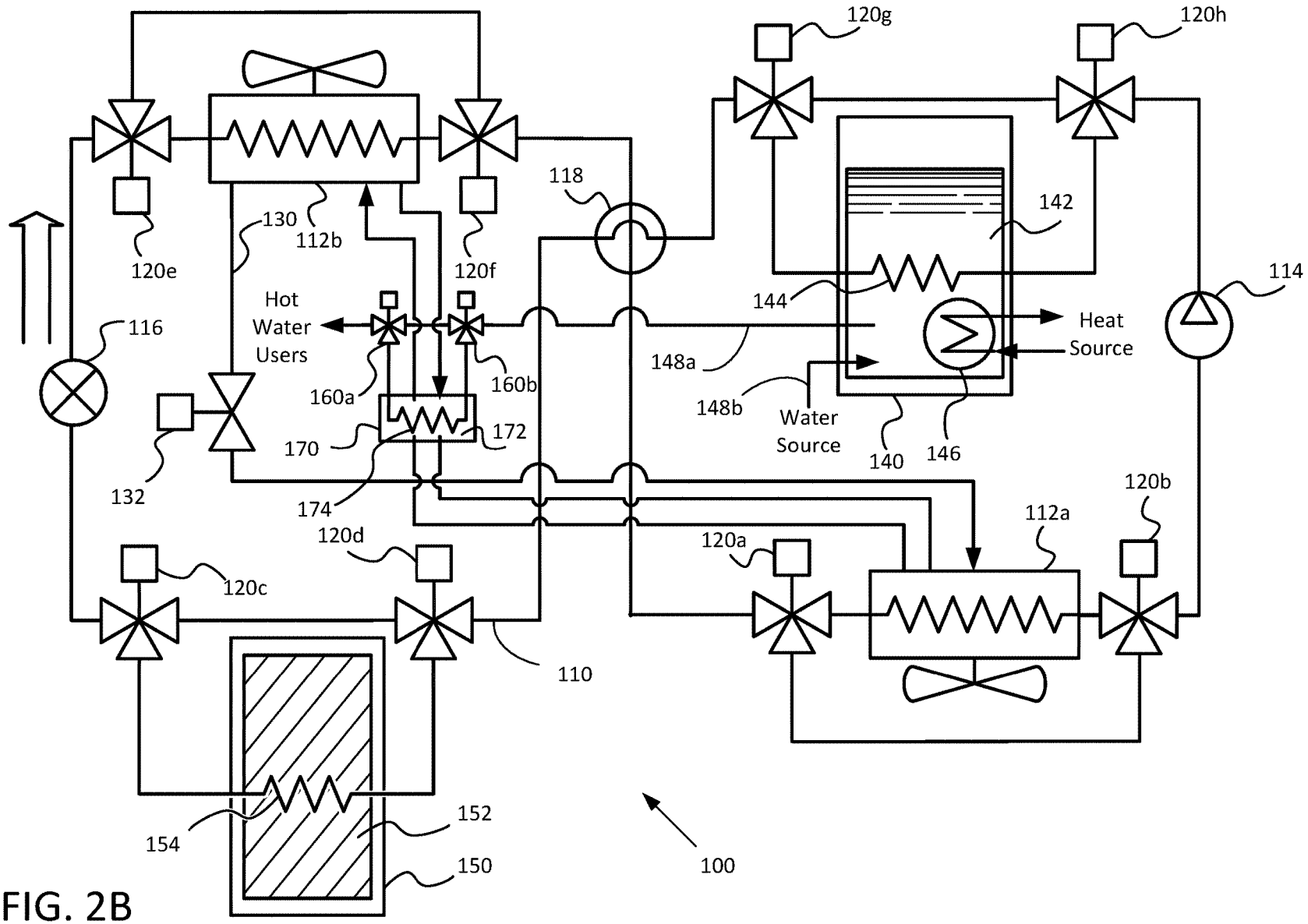

FIGS. 2A and 2B provide a schematic of a Heating Ventilation and Air Conditioning (HVAC) system 100 including thermal energy reservoirs, according to embodiments of the present disclosure. Similarly to the embodiment discussed in relation to FIGS. 1A and 1B, the HVAC system 100 illustrated in FIGS. 2A and 2B includes a refrigerant circuit 110 that includes a first heat exchanger 112*a* (generally or collectively, heat exchanger 112) located in or in communication with a conditioned environment (e.g., as an "indoor" unit of the HVAC system 100), a second heat exchanger 112*b* located in or in communication with a non-conditioned environment (e.g., as an "outdoor" unit of the HVAC system 100), a compressor 114, an expansion device 116, and a four-way valve 118 that is controllable to route a refrigerant carried by the refrigerant circuit 110 in a first direction while in the cooling mode (as shown in FIG. 2A) and in a second direction, opposite to the first direction, while in the heating mode (as shown in FIG. 2B). In contrast to the embodiment discussed in relation to FIGS. 1A and 1B, however, the HVAC system 100 illustrated in FIGS. 2A and 2B alters the relative placement of the first heat exchanger 112*a* and the thermal storage tank 150 relative to the compressor 114 and the expansion device 116, which may result in different plumbing and ducting between the various elements.

By placing a thermal storage tank 150 before a first heat exchanger 112*a* in the fluid path of the refrigerant circuit 110 (e.g., upstream) in the cooling mode (as in FIG. 2A), the thermal media 152 can be used to further chill the refrigerant before using the refrigerant to chill the conditioned environment. In contrast, by placing a thermal storage tank 150 after a first heat exchanger 112*a* in the fluid path of the refrigerant circuit 110 (e.g., downstream) in the cooling mode (as in FIG. 1A), the thermal media 152 can be used to expel additional thermal energy into the refrigerant (e.g., to provide a usable temperature for heating water 142), or to act as a pre-chilling reserve for a currently disconnected (and not illustrated) first heat exchanger 112*a*. Various other considerations, such as the physical spaces needed to deploy the various elements may also affect the order of deployment of the heat exchangers and thermal energy reservoirs.

Figure 3A:
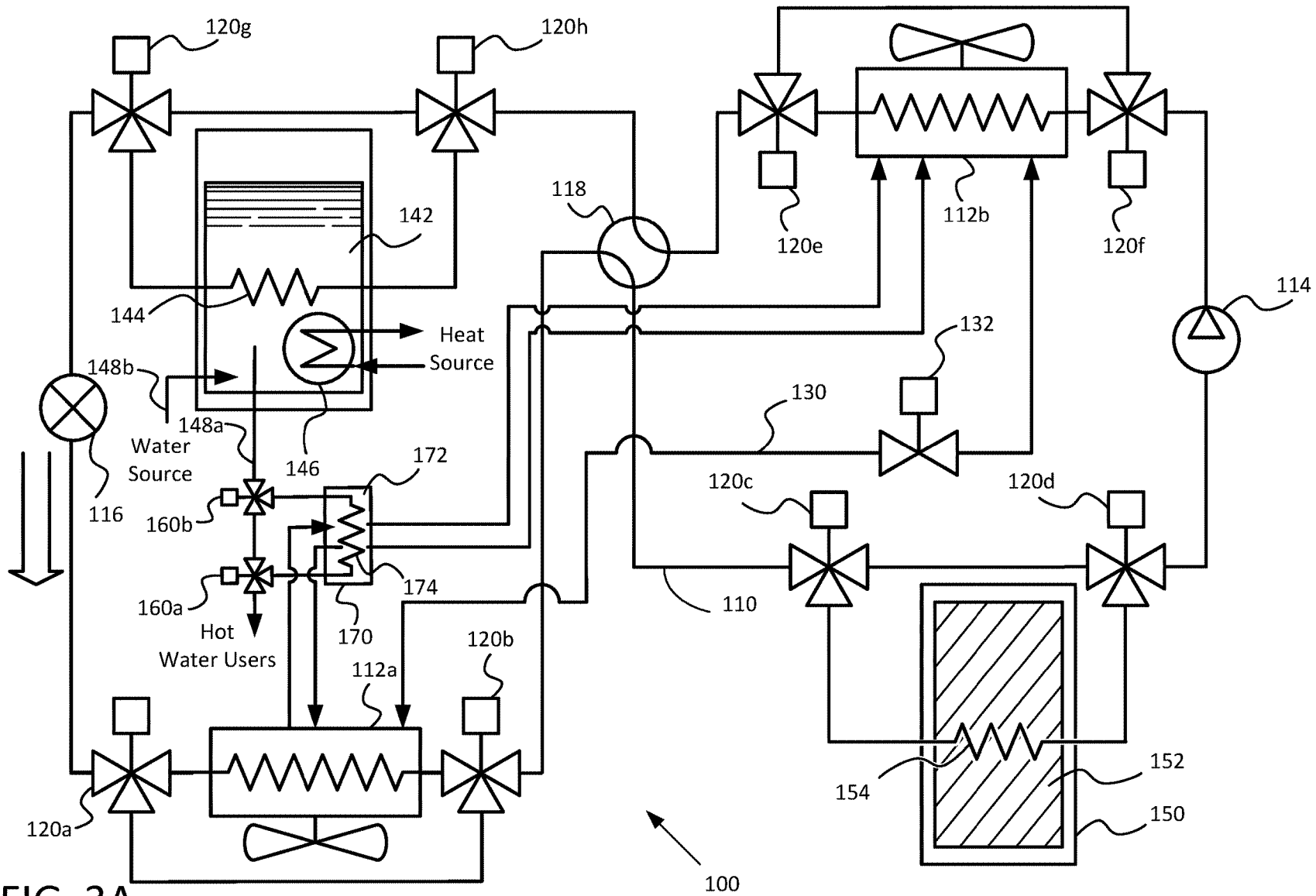
FIGS. 3A and 3B provide a schematic of an HVAC system including thermal energy reservoirs, according to embodiments of the present disclosure.
Figure 3B:
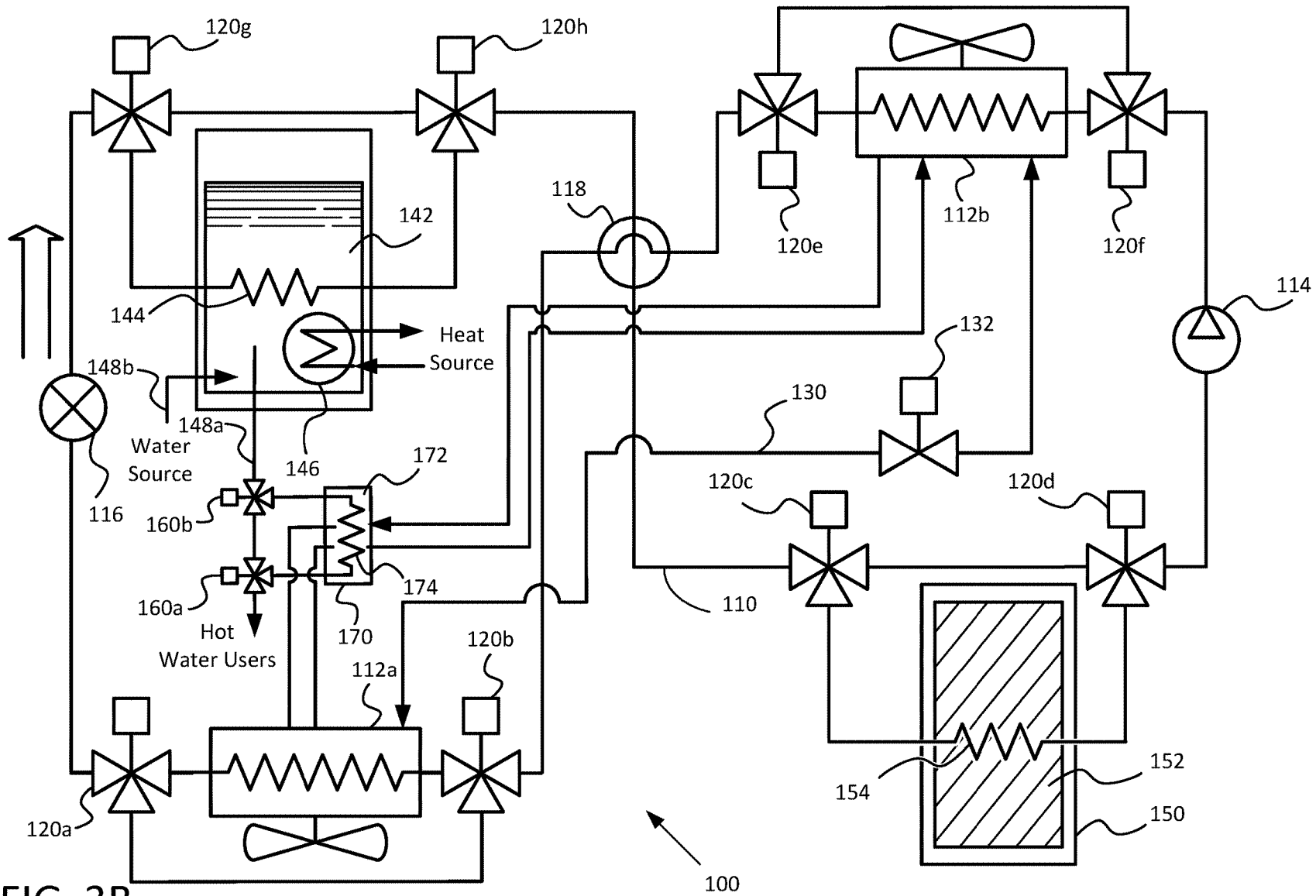

FIGS. 3A and 3B provide a schematic of a Heating Ventilation and Air Conditioning (HVAC) system 100 including thermal energy reservoirs, according to embodiments of the present disclosure. Similarly to the embodiment discussed in relation to FIGS. 1A and 1B, the HVAC system 100 illustrated in FIGS. 3A and 3B includes a refrigerant circuit 110 that includes a first heat exchanger 112*a* (generally or collectively, heat exchanger 112) located in or in communication with a conditioned environment (e.g., as an "indoor" unit of the HVAC system 100), a second heat exchanger 112*b* located in or in communication with a non-conditioned environment (e.g., as an "outdoor" unit of the HVAC system 100), a compressor 114, an expansion device 116, and a four-way valve 118 that is controllable to route a refrigerant carried by the refrigerant circuit 110 in a first direction while in the cooling mode (as shown in FIG. 3A) and in a second direction, opposite to the first direction, while in the heating mode (as shown in FIG. 3B). In contrast to the embodiment discussed in relation to FIGS. 1A and 1B, however, the HVAC system 100 illustrated in FIGS. 3A and 3B alters the relative placement of the second heat exchanger 112*b* and the hot water tank 140 relative to the compressor 114 and the expansion device 116, which may result in different plumbing and ducting between the various elements.

By placing a hot water tank 140 before a second heat exchanger 112*b* in the fluid path of the refrigerant circuit 110 (e.g., upstream) in the heating mode (as in FIG. 3B), the water 142 can be used to further heat the refrigerant to defrost the second heat exchanger 112*b* without (or in addition to) directly routing the water 142 via the 160 to defrost the second heat exchanger 112*b*, and use the residual thermal energy to heat the conditioned environment. In contrast, by placing a thermal storage tank 150 after a second heat exchanger 112*b* in the fluid path of the refrigerant circuit 110 (e.g., downstream) in the heating mode (as in FIG. 1B), the water 142 can be used to further warm the refrigerant before using the refrigerant to warm the conditioned environment. Various other considerations, such as the physical spaces needed to deploy the various elements may also affect the order of deployment of the heat exchangers and thermal energy reservoirs.

The embodiments shown in FIGS. 1A and 1B, 2A and 2B, and 3A and 3B may represent different deployments of hardware components, or different routings among the same hardware components. Accordingly, FIGS. 1A and 1B, 2A and 2B, and 3A and 3B may be understood according to FIG. 4, which 4 illustrates the routing of the refrigerant circuit 110 with multiple arrangements of thermal reservoirs 410 and heat exchangers 420, according to embodiments of the present disclosure. Because the HVAC system 100 may include multiple heat exchangers 112 in the conditioned environment, multiple heat exchangers 112 in the non-conditioned environment, multiple hot water tanks 140, and multiple thermal storage tanks 150, one of skill in the art will recognize that the HVAC system 100 illustrated in FIGS. 1A-3B may be freely combined into various embodiments to suit the heating and cooling needs of various conditioned environments. For example, an HVAC system 100 may include a refrigerant circuit 110 that includes two or more first heat exchangers 112*a* between the expansion device 116 and the four-way valve 118. In another example, the HVAC system 100 may include a refrigerant circuit 110 that includes a first heat exchanger 112*a* disposed between two thermal storage tanks 150, or a hot water tank 140 disposed between two sets of two second heat exchangers 112*b*.

Figure 4:
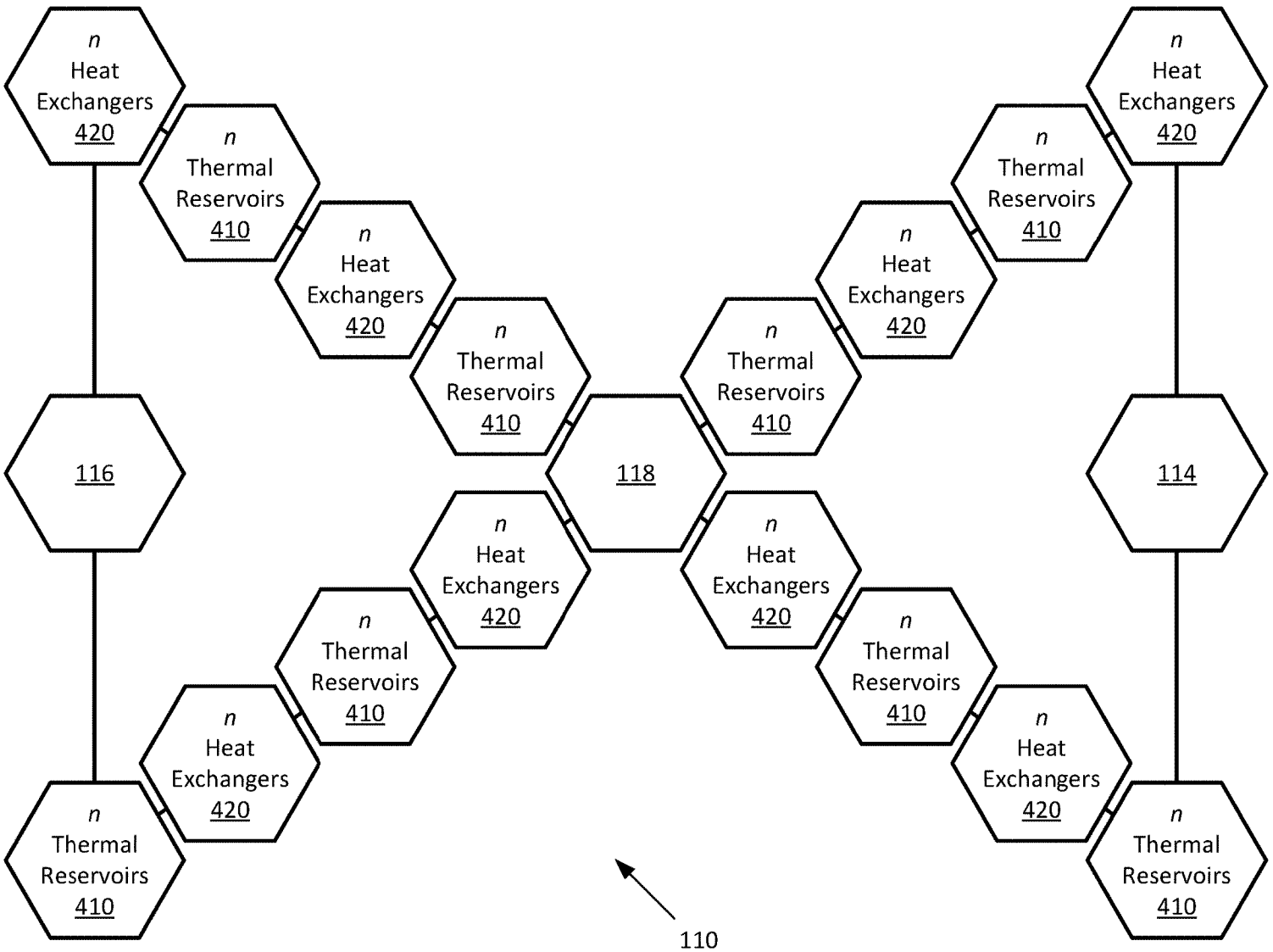
FIG. 4 illustrates the routing of the refrigerant circuit with multiple arrangements of thermal reservoirs and heat exchangers, according to embodiments of the present disclosure.

Accordingly, as is shown in FIG. 4, sets of n heat exchangers 420 (e.g., zero or more heat exchangers 112) may be located between sets of n thermal reservoirs 410 (e.g., zero or more hot water tanks 140 or thermal storage tanks 150), where n is any non-negative integer. In various embodiments, the individual thermal energy reservoirs 140/150 included in each set of n thermal reservoirs 410 may include two or more heat thermal energy reservoirs 140/150 disposed in series to augment the heating/cooling charging capacity for one environment, and additionally or alternatively may include two or more thermal energy reservoirs 140/150 disposed in parallel to serve the heating/cooling charging needs for different environments or sub-regions of one environment. Similarly, the individual heat exchangers 112 included in each set of n heat exchangers 420 may include two or more heat exchangers 112 disposed in series to augment the heating/cooling ability for one environment, and additionally or alternatively may include two or more heat exchangers 112 disposed in parallel to serve the heating/cooling needs for different environments or sub-regions of one environment.

Figure 5:
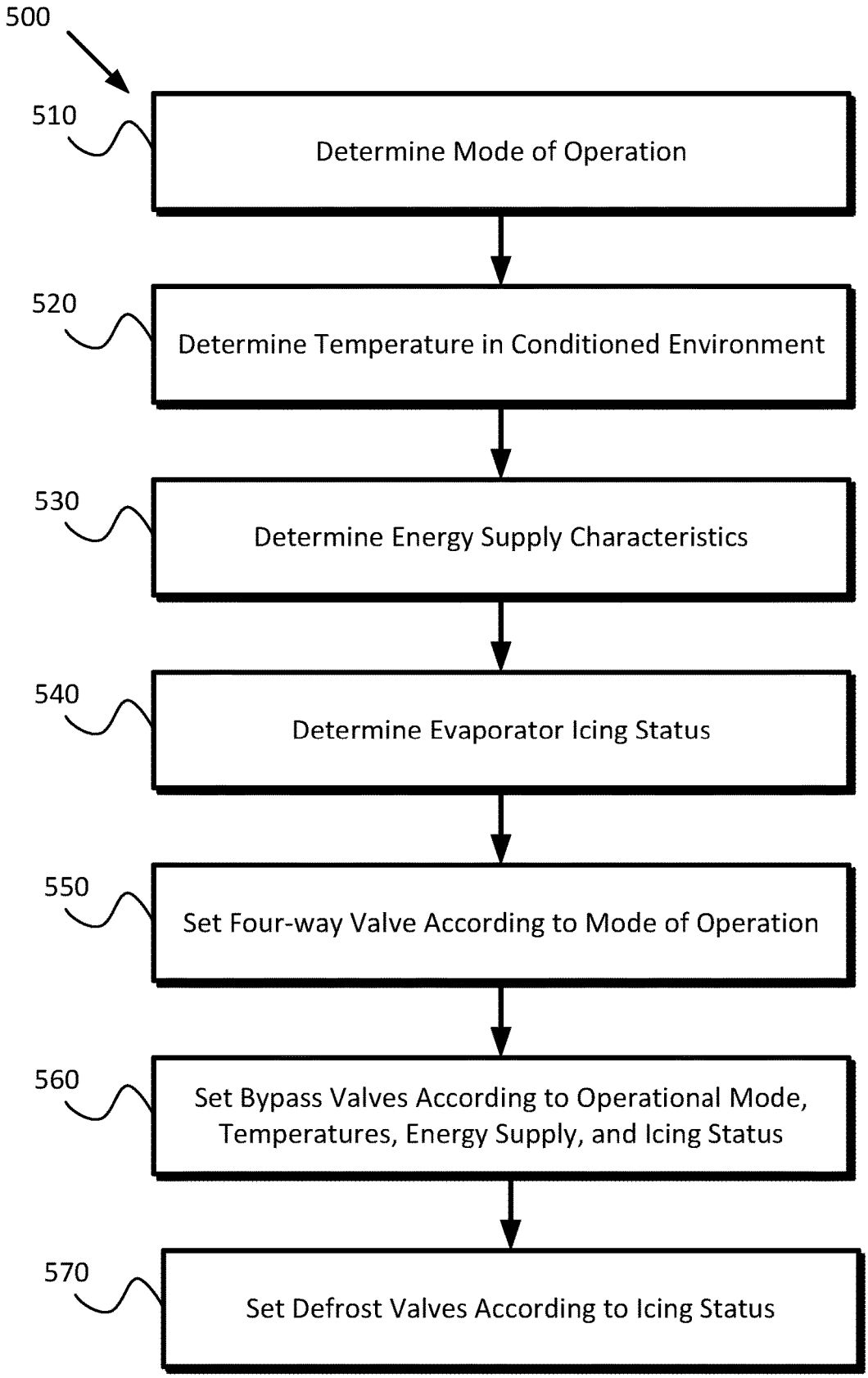
FIG. 5 is a flowchart of a method of controlling an HVAC system including thermal energy reservoirs, according to embodiments of the present disclosure.

FIG. 5 is a flowchart of a method 500 of controlling an HVAC system 100 including thermal energy reservoirs, according to embodiments of the present disclosure. Method 500 may be applied via a controller, such as that described in FIG. 6, in combination with any of the layouts for an HVAC system 100 described in relation to FIGS. 1A-4.

Method 500 begins at operation 510, where the controller for the HVAC system 100 determines a mode of operation for the HVAC system 100. In various embodiments, the mode of operation may include "cool" or "heat" to decrease or increase the temperature of a conditioned environment. Other modes of operation may include "emergency heat" (e.g., where resistive electrical heaters or fuel powered heaters are used to supplement or replace the heating capacity of the heat exchangers 112) or "off" (e.g., where the powered elements of the HVAC system 100 are disengaged or not activated).

At operation 520, the controller determines the temperature in the conditioned environment and in the thermal reservoirs. In various embodiments, the controller may receive temperature information from one or more zones in the conditioned environment from thermometers disposed in the environment and may receive a desired temperature or temperature range for the conditioned environment. The desired temperature may include a range to define an activation temperature to avoid cycling the HVAC system 100 on and off for minor changes in temperature in the conditioned environment. For example, user may set a desired temperature of X degrees for the conditioned environment that the HVAC system 100 attempts to match depending on the mode of operation within Y degrees to define an activation temperature of X±Y degrees. Accordingly, in a heating mode, the HVAC system 100 may heat the conditioned environment up to or beyond X degrees and stop heating the environment until the temperature drops to below X-Y degrees. Similarly, in a cooling mode, the HVAC system 100 may cool the conditioned environment down to or below X degrees and stop cooling the environment until the temperature raises to above X+Y degrees. Similarly, various thermometers and cooling/heating ranges may be used to monitor the temperature in the thermal reservoirs.

At operation 530, the controller determines energy supply characteristics. In various embodiments, the supply characteristics may include absolute energy availability over time (e.g., whether sufficient energy is available at hour H to run the HVAC system 100) as well as rates or qualities of the available energy (e.g., price per kilowatt hour, whether the energy source is renewable or "green", etc.). The energy supply characteristics may be based on historical data (e.g., pattern of power generation for solar panels), or may be supplied from a power station based on schedules or predictions (e.g., risk percentage of brown out, scheduled downtime for rolling blackouts or maintenance, etc.) or based on real-time analysis (e.g., what percent of the power in the grid is from renewable sources).

At operation 540, the controller determines an icing status of the heat exchanger 112 operating as an evaporator. In various embodiments, the controller may receive temperature data from a thermometer located on or near the evaporator to determine when the temperature is at or approaching the freezing point, at which ice may begin accumulating around or on the heat exchanger 112.

At operation 550, the controller sets a four-way valve 118 to route a refrigerant through a refrigerant circuit 110 in a first direction when the HVAC system 100 is set to the cooling mode (as in FIGS. 1A, 2A, and 3A) or in the second direction, opposite to the first direction, when the HVAC system 100 is set to a heating mode (as in FIGS. 1B, 2B, and 3B).

At operation 560, the controller sets bypass valves 120 in the refrigerant circuit 110 according to the operational mode (heating or cooling), temperatures of the temperature holding material in the thermal energy reservoirs and conditioned/non-conditioned environments, an energy supply availability, and the icing status of the heat exchangers 112.

In one example, when in the cooling mode, the bypass valves 120 may be set to bypass any thermal energy reservoirs and route the refrigerant between a first heat exchanger 112*a* and a second heat exchanger 112*b* to cool the conditioned environment and expel collected thermal energy from the conditioned environment to the non-conditioned environment.

In one example, when in the cooling mode, the bypass valves 120 may be set to bypass a hot water tank 140 and route the refrigerant between a thermal storage tank 150, a first heat exchanger 112*a*, and a second heat exchanger 112*b* to cool the conditioned environment and expel collected thermal energy from the conditioned environment to the non-conditioned environment. Depending on the order of the flow within the refrigerant circuit, the refrigerant may first cool the air in the conditioned environment (as in FIG. 1A) or the thermal media 152 within the thermal storage tank 150 (as in FIG. 2A). When the first heat exchanger 112*a* receives the refrigerant before the thermal storage tank 150, the refrigerant may be chilled according to the cooling needs of the conditioned environment when provided to the first heat exchanger 112*a* to cool the conditioned environment, and any additional cooling capacity in the refrigerant is then used to absorb thermal energy from the thermal media 152. When the first heat exchanger 112*a*receives the refrigerant after the thermal storage tank 150, the refrigerant may be over-chilled relative to the cooling needs of the conditioned environment to charge the thermal media 152 to a desired temperature before being sent to the first heat exchanger 112*a* to cool the conditioned environment with the residual cooling capacity of the refrigerant. Additionally or alternatively, when the first heat exchanger 112*a* receives the refrigerant after the thermal storage tank 150, the refrigerant may be under-chilled relative to the cooling needs of the conditioned environment to discharge the thermal media 152 to a further cool the refrigerant to a desired temperature before being sent to the first heat exchanger 112*a* to cool the conditioned environment with the additional cooling capacity of the refrigerant recovered from the thermal media 152.

In one example, when in the cooling mode, the bypass valves 120 may be set to bypass a thermal storage tank 150 and route the refrigerant between a hot water tank 140, a first heat exchanger 112*a*, and a second heat exchanger 112*b* to cool the conditioned environment and expel collected thermal energy from the conditioned environment to the non-conditioned environment and the water 142. Depending on the order of the flow within the refrigerant circuit, the refrigerant may first expel heat to the air in the non-conditioned environment (as in FIG. 2A) or the water 142 within the hot water tank 140 (as in FIG. 1A).

In one example, when in the cooling mode, the bypass valves 120 may be set to bypass a hot water tank 140 and a second heat exchanger 112*b* and route the refrigerant between a thermal storage tank 150 and a first heat exchanger 112*a* to cool the conditioned environment and expel collected thermal energy from the conditioned environment to the thermal media 152.

In one example, when in the cooling mode, the bypass valves 120 may be set to bypass a thermal storage tank 150 and a second heat exchanger 112*b* and route the refrigerant between a hot water tank 140 and a first heat exchanger 112*a* to cool the conditioned environment and expel collected thermal energy from the conditioned environment to the water 142.

In one example, when in the cooling mode, the bypass valves 120 may be set to bypass a hot water tank 140 and a first heat exchanger 112*a* and route the refrigerant between a thermal storage tank 150 and a second heat exchanger 112*b* to cool the conditioned thermal media 152 (without cooling the conditioned environment) and expel collected thermal energy from the thermal media 152 to the non-conditioned environment.

In one example, when in the cooling mode, the bypass valves 120 may be set to bypass a second heat exchanger 112*b* and route the refrigerant between a hot water tank 140, a thermal storage tank 150, and a first heat exchanger 112*a* to cool the conditioned environment and/or a thermal media 152 and expel collected thermal energy to the water 142, for example, when the second heat exchanger 112*b* is being defrosted or serviced, and cooling is still desired. When the first heat exchanger 112*a* receives the refrigerant before the thermal storage tank 150, the refrigerant may be chilled according to the cooling needs of the conditioned environment when provided to the first heat exchanger 112*a* to cool the conditioned environment, and any additional cooling capacity in the refrigerant is then used to absorb thermal energy from the thermal media 152. When the first heat exchanger 112*a* receives the refrigerant after the thermal storage tank 150, the refrigerant may be over-chilled relative to the cooling needs of the conditioned environment to charge the thermal media 152 to a desired temperature before being sent to the first heat exchanger 112*a* to cool the conditioned environment with the residual cooling capacity of the refrigerant. Additionally or alternatively, when the first heat exchanger 112*a* receives the refrigerant after the thermal storage tank 150, the refrigerant may be under-chilled relative to the cooling needs of the conditioned environment to discharge the thermal media 152 to a further cool the refrigerant to a desired temperature before being sent to the first heat exchanger 112*a* to cool the conditioned environment with the additional cooling capacity of the refrigerant recovered from the thermal media 152 (e.g., when the heat sinking capacity of the water tank heat exchanger 144 via the water 142 is less than the expelling environment via the second heat exchanger 112*b*).

In one example, when in the cooling mode, the bypass valves 120 may be set to bypass a first heat exchanger 112*a* and route the refrigerant between a hot water tank 140, a thermal storage tank 150, and a second heat exchanger 112*b* to cool the thermal media 152 and expel collected thermal energy to the water 142 and the non-conditioned environment, for example, when the first heat exchanger 112*a* is being defrosted or serviced, or when cooling is not currently desired, but to charge the thermal media 152 to a desired temperature when energy availability is high.

In one example, when in the cooling mode, the bypass valves 120 may be set to route the refrigerant between a hot water tank 140, a thermal storage tank 150, a first heat exchanger 112*a*, and a second heat exchanger 112*b* to cool the conditioned environment and a thermal media 152 and expel collected thermal energy to the water 142 and the non-conditioned environment.

In one example, when in the cooling mode, the bypass valves 120 may be set to bypass the first heat exchanger 112*a* and the second heat exchanger 112*b*, and route the refrigerant between the hot water tank 140 and the thermal storage tank 150 to heat the water 142 via the thermal energy stored in the thermal media 152 when the conditioned environment does not need to be cooled. In this process, the thermal media 152 can be cooled as required.

In one example, when in the heating mode, the bypass valves 120 may be set to bypass any thermal energy reservoirs and route the refrigerant between a first heat exchanger 112*a* and a second heat exchanger 112*b* to heat the conditioned environment and using thermal energy absorbed from the non-conditioned environment.

In one example, when in the heating mode, the bypass valves 120 may be set to bypass a thermal storage tank 150 and route the refrigerant between a hot water tank 140, a first heat exchanger 112*a*, and a second heat exchanger 112*b* to heat the conditioned environment and the water 142. Depending on the order of the flow within the refrigerant circuit, the refrigerant may first heat the air in the conditioned environment (as in FIG. 3B) or the water 142 within the hot water tank 140 (as in FIG. 1B). When the first heat exchanger 112*a* receives the refrigerant before the hot water tank 140, the refrigerant may be heated according to the heating needs of the conditioned environment when provided to the first heat exchanger 112*a* to heat the conditioned environment, and any additional thermal energy in the refrigerant is then applied to the water 142 via the water tank heat exchanger 144. When the first heat exchanger 112*a* receives the refrigerant after the hot water tank 140, the refrigerant may be over-heated relative to the heating needs of the conditioned environment to charge the water 142 to a desired temperature before being sent to the first heat exchanger 112*a* to heat the conditioned environment with the residual thermal energy of the refrigerant. Additionally or alternatively, when the first heat exchanger 112*a* receives the refrigerant after the hot water tank 140, the refrigerant may be under-heated relative to the heating needs of the conditioned environment to discharge thermal energy from the water 142 to further heat the refrigerant to a desired temperature before being sent to the first heat exchanger 112*a* to heat the conditioned environment with the additional thermal energy stored in the water 142.

In one example, when in the heating mode, the bypass valves 120 may be set to bypass a thermal storage tank 150 and a second heat exchanger 112*b* and route the refrigerant between a hot water tank 140 and a first heat exchanger 112*a* to heat the conditioned environment using collected thermal energy stored in the water 142. For example, when running the second heat exchanger 112*b* is not possible due to icing or other servicing needs, or when not feasible given the available energy supply.

In one example, when in the heating mode, the bypass valves 120 may be set to bypass a thermal storage tank 150 and a first heat exchanger 112*a* and route the refrigerant between a hot water tank 140 and a second heat exchanger 112*b* to heat the water 142 (without heating the conditioned environment) using collected thermal energy from the non-conditioned environment. For example, when the conditioned environment is at or above an activation temperature for heating the conditioned environment, the heating capacity of the second heat exchanger 112*b* may continue to be used to heat the water 142 to a desired temperature and/or for use later in heating the refrigerant (e.g., to supplement or replace the heating capacity of the second heat exchanger 112*b*).

In each of the examples provided for setting the bypass valves 120, the controller may also bypass more than one of the listed elements (e.g., bypassing n hot water tanks 140), route the refrigerant to more than one of the listed elements (e.g., routed to n first heat exchangers 112*a*), and route the refrigerant to a subset of the available listed elements in the HVAC system 100 (e.g., in an HVAC system 100 having n thermal storage tanks 150, routing refrigerant to m thermal storage tanks 150 and bypassing n-m thermal storage tanks 150). Additionally, any example that recites that an element is bypassed may also be applied to describe HVAC systems 100 omitting the listed element (e.g., operation of an HVAC system 100 bypassing a hot water tank 140 may also describe an HVAC system 100 not connected to or omitting a hot water tank 140 from the refrigerant circuit 110).

In various embodiments, the controller may also signal a heat source in the hot water tank 140 to activate when the refrigerant has insufficient thermal energy to heat the water 142 to a desired temperature. Additionally or alternatively, when the refrigerant carries sufficient thermal energy to heat the water 142 to (or at least towards) a desired temperature, the controller may signal the heat source for the hot water tank 140 to delay activating for at least a threshold amount of time to allow the waste heat from the conditioned environment (when in a cooling mode) or the excess heating capacity of the second heat exchanger 112*b* with the non-conditioned environment to be used before activating the heat source.

At operation 570, the controller sets defrost valves to supply one or more of heated water 142 (e.g., via an outflow line 148*a*), heated air (e.g., via a defrost duct 130 to direct air from a hot heat exchanger 112 to a cold heat exchanger 112), or heated refrigerant (via reversing the setting of the four-way valve 118 as set in operation 550) to preemptively or reactively defrost the one of the heat exchangers 112 operating as an evaporator. Accordingly, the HVAC system 100 may continue operations while removing ice formed on the cold heat exchanger 112 or reducing the likelihood of ice formation thereon by raising the local temperature of the heat exchanging surfaces.

Method 500 may continuously run and the controller continuously set and reset the four-way valve 118 (per operation 550) and other valves in the HVAC system 100 (per operation 560 and operation 570) to adjust the operation of the HVAC system 100 to maintain the temperature in the conditioned environment and the thermal energy reservoirs.

FIG. 6 illustrates a computing device, as may be used as a controller 600 for an HVAC system 100 including thermal energy reservoirs, according to embodiments of the present disclosure. For example, the controller 600 can be used to control the blower(s), compressor(s), and valve(s) of an HVAC system 100 to route a refrigerant along different paths for heating and cooling. The controller 600 includes at least one processor 602, a non-transitory computer readable media 604, an optional input/output device 606, an optional machine learning model 608, an optional display 610, and a network communication module 612, all interconnected via a system bus 614. In at least one embodiment, the input/output device 606 and the display 610 may be combined into a single device, such as a touch-screen display. Software instructions executable by the processor 602 for implementing software instructions are stored within the controller 600 in accordance with the illustrative embodiments described herein, may be stored in the non-transitory computer readable media 604 or some other non-transitory computer-readable media.

Although not explicitly shown in FIG. 6, it should be recognized that the controller 600 may be connected to one or more public and/or private networks via appropriate network connections via the network communication module 612. It will also be recognized that software instructions may also be loaded into the non-transitory computer readable media 604 from an appropriate storage media or via wired or wireless means. The network communication module 612 may also be connected to one or more thermostats, thermometers, hydrometers, flowmeters, motor controls, or the like to monitor and send commands to various components of the HVAC system 100.

For example, during operations, ice formation may be detected by the controller 600 monitoring the temperature measurement of temperature sensors on the heat exchangers. Temperatures at or below 0° C. (32° F.) indicate conditions where ice can form, so an initial measurement of 0° C. (32° F.), or a continued measurement of 0° C. (32° F.) may be used to begin the defrost mode of operation on an associated heat exchanger.

Additionally or alternatively, the controller 600 may be configured to collect measurements of the outdoor air temperature and/or the outdoor air humidity and to analyze historical conditions where ice can form for use with the machine learning model 608. The temperature of the outdoor heat exchangers, and thus the instances of ice formation, are dependent on the operating conditions (e.g., usage demand) of the HVAC system 100, which the machine learning model 686 may use as an input to control the HVAC system 100 and feedback to improve operations over time. Therefore, a database in the computer readable media 604 may record temperatures from the sensors on the outdoor heat exchangers, and/or operational parameters of the compressors for use as historical measurements and historical operating conditions to train the machine learning model 608 for use in the HVAC system 100. For example, the machine learning model 608 may correlate historical measurements from the sensors to the historical operating conditions of the particular HVAC system 100 (e.g., stored in the database) to predictively control the HVAC system 100 using current measurements from the sensors to control when and how the HVAC system 100 operates (e.g., to initiate the defrost mode before the sensors report temperatures at or below 0° C. (32° F.) or ice formation otherwise begins on the outdoor heat exchangers).

In some embodiments, the controller 600 may use a machine learning model 608 to determine times and lengths to charge various thermal energy reservoirs to a desired temperature or to discharge from the various thermal energy reservoirs to adjust a temperature of a refrigerant. For example, the machine learning model 608 may be trained based on historic energy availability patterns when to charge the thermal energy reservoirs (e.g., pre-cooling or pre-heating) to make use of lower energy rates, variable energy supplies (e.g., from solar and wind sources), and capacity limitations of the HVAC system 100. For example, the machine learning model 608 may identify that to maintain a conditioned environment at X degrees all day, the HVAC system 100 should be used at night to cool a thermal media 152 when the conditioned environment is naturally at or below X degrees, so that the cooled thermal media 152 can be used to supplement or substitute for the cooling capacity of the heat exchangers during the day when the outdoor temperature is above X degrees. In another example, the machine learning model 608 may identify that to maintain a conditioned environment at Y degrees all day, the HVAC system 100 should be used during the day to heat water 142 in a water tank 140 when the conditioned environment is naturally at or above Y degrees, so that the heated water 142 can be used to supplement or substitute for the heating capacity of the heat exchangers at night when the outdoor temperature is below Y degrees (or a heating element of a water tank 140 during the day).

In some examples, different deployments of the HVAC system 100 may individually train a locally deployed machine learning model 608 to react differently to current sensor measurements and operating conditions according to the differences in the environments in which the different HVAC systems 100 are deployed, mechanical differences between the different HVAC systems 100, differences in the age or length of service between the different HVAC systems 100, or the like. In some examples, the historical data from one or multiple deployments of HVAC systems 100 may be used as a base or pre-trained machine learning model 608 in the controller 600 for use in newly deployed HVAC systems 100. Additionally or alternatively, historical data that are aggregated from multiple deployments may be used to train a machine learning model 608 that is included for use in the controllers 600 of multiple deployments of the HVAC systems 100, thereby allowing for collective learning and control in addition to or alternatively to individual learning and control.

In various examples the machine learning model 608 may include various algorithms used to provide "artificial intelligence" to the controller. These machine learning models 608 may include reinforcement learning algorithms, Artificial Neural Networks, decision trees, support vector machines, genetic algorithms, Bayesian networks, or the like. The models may include publicly available services (e.g., via an Application Program Interface with the provider) as well as purpose-trained or proprietary services, which may be deployed locally or accessed via a networked service. One of ordinary skill in the relevant art will recognize that different domains may benefit from the use of different machine learning models 608, which may be continuously or periodically trained based on received feedback. Accordingly, the person of ordinary skill in the relevant art will be able to select or design an appropriate machine learning model 608 based on the details provided in the present disclosure to predictively set operating parameters for the HVAC systems 100 based on correlations found between current sensors readings and historical sensor readings and between the corresponding historical states of the HVAC systems 100 and the desired current states of the HVAC systems 100.

In addition to the embodiments described above, many examples of specific combinations are within the scope of the disclosure, some of which are detailed below:

Clause 1: An HVAC system for operation with a refrigerant, comprising: a thermal storage tank storing thermal media; a hot water tank storing water; a refrigerant circuit comprising: a first heat exchanger located in or in communication with a conditioned environment; a second heat exchanger located in or in communication with a non-conditioned environment, wherein the second heat exchanger is in fluid communication with the first heat exchanger via the refrigerant circuit; thermal storage tank bypass valves, configurable to selectively route the refrigerant carried via the refrigerant circuit through a thermal storage tank heat exchanger to exchange thermal energy with the thermal media in a coolant charging mode or a coolant discharging mode or configurable to selectively bypass the thermal storage tank heat exchanger in a coolant holding mode; water tank bypass valves, configurable to selectively route the refrigerant through a water tank heat exchanger to exchange thermal energy with the water in a heater charging mode or a heater"disc'arging mode or configurable to selectively bypass the water tank heat exchanger in a heater holding mode; and a four-way valve, configurable to route the refrigerant through the refrig"rant' circuit in a first direction when in a cooling mode and in a second direction, opposite the first direction, when in a heating mode.

Clause 2: The HVAC system of any of clauses 1 and 3-8, further comprising a hot water valve connected between the first heat exchanger, the second heat exchanger, and the hot water tank and configurable to selectively route water to the first heat exchanger or the second heat exchanger from the hot water tank to defrost the first heat exchanger or the second heat exchanger.

Clause 3: The HVAC system of any of clauses 1, 2, and 4-8, wherein the refrigerant extracts thermal energy from one or both of the non-conditioned environment via the second heat exchanger and the water via the water tank heat exchanger.

Clause 4: The HVAC system of any of clauses 1-3 and 5-8, wherein the refrigerant expels thermal energy to one or both of the non-conditioned environment via the second heat exchanger and the water via the water tank heat exchanger.

Clause 5: The HVAC system of any of clauses 1-4 and 6-8, wherein the refrigerant extracts thermal energy from one or both of the conditioned environment via the first heat exchanger and the thermal media via the thermal storage tank heat exchanger.

Clause 6: The HVAC system of any of clauses 1-5, 7, and 8, wherein the refrigerant expels thermal energy to one or both of the conditioned environment via the first heat exchanger and the thermal media via the thermal storage tank heat exchanger.

Clause 7: The HVAC system of any of clauses 1-7 and 8, wherein the refrigerant extracts thermal energy from the non-conditioned environment via the second heat exchanger and expels the thermal energy to the water via the water tank heat exchanger and not to the conditioned environment when the conditioned environment is at or above a desired temperature.

Clause 8: The HVAC system of any of clauses 1-7, wherein the refrigerant expels thermal energy to the thermal media via the thermal storage tank heat exchanger before extracting thermal energy from the conditioned environment via the first heat exchanger.

Clause 9: An HVAC system for use with a refrigerant, comprising: a compressor, an outdoor heat exchanger, an indoor heat exchanger, an expansion device, and a four-way valve connected together as a refrigerant circuit, wherein the four-way valve is configurable to route the refrigerant through the expansion device in a first direction in a cooling mode and in a second direction, opposite the first direction, in a heating mode; and a thermal energy reservoir connected to the refrigerant circuit by a first bypass valve and a second bypass valve, wherein the first bypass valve and the second bypass valve are configurable to selectively route the refrigerant through a reservoir heat exchanger in the thermal energy reservoir when in a charging mode to exchange thermal energy with thermal storage media and disconnect fluid communication between the refrigerant circuit and the reservoir heat exchanger when in a holding mode.

Clause 10: The HVAC system of any of clauses 9 and 11-16, further comprising a second thermal energy reservoir connected to the refrigerant circuit by a third bypass valve and a fourth bypass valve, wherein the third bypass valve and the fourth bypass valve are configurable to selectively route the refrigerant through a second reservoir heat exchanger in the second thermal energy reservoir to exchange thermal energy with a second thermal storage media when in a charging mode and disconnect fluid communication between the refrigerant circuit and the second reservoir heat exchanger when in a holding mode.

Clause 11: The HVAC system of any of clauses 9, 10, and 12-16, further comprising a second thermal energy reservoir connected to the refrigerant circuit by a third bypass valve and a fourth bypass valve, wherein the third bypass valve and the fourth bypass valve are configurable to selectively route the refrigerant through a second reservoir heat exchanger in the second thermal energy reservoir to exchange thermal energy with a second thermal storage media of a same type as the thermal storage media when in a charging mode and disconnect fluid communication between the refrigerant circuit and the second reservoir heat exchanger when in a holding mode, wherein the thermal energy reservoir is disposed in series with the second thermal energy reservoir in the refrigerant circuit.

Clause 12: The HVAC system of any of clauses 9-11 and 13-16, further comprising a second thermal energy reservoir connected to the refrigerant circuit by a third bypass valve and a fourth bypass valve, wherein the third bypass valve and the fourth bypass valve are configurable to selectively route the refrigerant through a second reservoir heat exchanger in the second thermal energy reservoir to exchange thermal energy with a second thermal storage media of a same type as the thermal storage media when in a charging mode and disconnect fluid communication between the refrigerant circuit and the second reservoir heat exchanger when in a holding mode, wherein the thermal energy reservoir is disposed in parallel with the second thermal energy reservoir in the refrigerant circuit to serve a different environment than the second thermal energy reservoir.

Clause 13: The HVAC system of any of clauses 9-12 and 14-16, further comprising a hot water valve connected between the indoor heat exchanger, the outdoor heat exchanger, and the thermal energy reservoir and configurable to selectively route hot water to the indoor heat exchanger or the outdoor heat exchanger from the thermal energy reservoir to defrost the indoor heat exchanger or the outdoor heat exchanger in response to detecting ice formation conditions at the indoor heat exchanger or the outdoor heat exchanger.

Clause 14: The HVAC system of any of clauses 9-13, 15, and 16, further comprising a second indoor heat exchanger connected in the refrigerant circuit.

Clause 15: The HVAC system of any of clauses 9-14 and 16, further comprising a second outdoor heat exchanger connected in the refrigerant circuit.

Clause 16: The HVAC system of any of clauses 9-15, further comprising a controller configured to operate the compressor and configure the valves included in the refrigerant circuit to selectively flow refrigerant through the thermal energy reservoir to place the thermal energy reservoir in the charging mode by exchanging thermal energy with thermal storage media and selectively bypass refrigerant around the thermal energy reservoir to place the thermal energy reservoir into the holding mode based at least one of: a historic heating/cooling demand curve, a temperature of a temperature holding material in the thermal energy reservoir, an energy availability characteristic, or an icing status of the indoor heat exchanger and the outdoor heat exchanger.

Clause 17: A controller for an HVAC system, comprising: a processor; and a memory storing instructions, that when executed by the processor perform operations comprising: setting a four-way valve to route a refrigerant through a refrigerant circuit in a first direction when the HVAC system is set to a cooling mode or in a second direction, opposite to the first direction, when the HVAC system is set to a heating mode; and setting bypass valves in the refrigerant circuit based on a temperature of a temperature holding material in a thermal energy reservoir and which of the heating mode and the cooling mode the four-way valve is set to, wherein the bypass valves route the refrigerant through the thermal energy reservoir to transfer thermal energy between the refrigerant and the temperature holding material.

Clause 18: The controller of any of clauses 17 and 19-22, the operations further comprising setting defrost valves to route at least one of heated air from a hot heat exchanger to a cold heat exchanger in the refrigerant circuit and heated temperature holding material from the thermal energy reservoir to the cold heat exchanger.

Clause 19: The controller of any of clauses 17, 18 and 20-22, wherein setting the bypass valves comprises setting the bypass valves to route the refrigerant cooled by an outdoor heat exchanger to the thermal energy reservoir and to bypass an indoor heat exchanger to cool the temperature holding material held by the thermal energy reservoir instead of cooling a conditioned environment via the indoor heat exchanger when the HVAC system is in the cooling mode and a temperature in a conditioned environment is at or below an activation temperature for cooling the conditioned environment.

Clause 20: The controller of any of clauses 17-19, 21, and 22, wherein setting the bypass valves comprises setting the bypass valves to route the refrigerant cooled by an outdoor heat exchanger to the thermal energy reservoir and to an indoor heat exchanger to further cool the refrigerant by expelling thermal energy to the temperature holding material before routing the refrigerant to the indoor heat exchanger to cool a conditioned environment via the indoor heat exchanger when the HVAC system is in the cooling mode and a temperature in a conditioned environment is at or above an activation temperature for cooling the conditioned environment.

Clause 21: The controller of any of clauses 17-20 and 22, wherein setting the bypass valves comprises setting the bypass valves to route the refrigerant heated by an outdoor heat exchanger to the thermal energy reservoir and to an indoor heat exchanger to further heat the refrigerant by extracting thermal energy from the temperature holding material before routing the refrigerant to the indoor heat exchanger to heat a conditioned environment via the indoor heat exchanger when the HVAC system is in the heating mode and a temperature in a conditioned environment is at or below an activation temperature for heating the conditioned environment.

Clause 22: The controller of any of clauses 17-21, wherein setting the bypass valves comprises setting the bypass valves routes the refrigerant heated by an outdoor heat exchanger to the thermal energy reservoir and to bypass an indoor heat exchanger to heat the temperature holding material held by the thermal energy reservoir instead of heating a conditioned environment via the indoor heat exchanger when the HVAC system is in the heating mode and a temperature in a conditioned environment is at or above an activation temperature for heating the conditioned environment.

Certain terms are used throughout the description and claims to refer to particular features or components. As one skilled in the art will appreciate, different persons may refer to the same feature or component by different names. This document does not intend to distinguish between components or features that differ in name but not function.

For the embodiments and examples above, a non-transitory computer readable media can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed.

Optionally, the rotating equipment (e.g., motors) and valves disclosed herein are envisaged as being operable at specified speeds or variable speeds through inverter circuitry, for example. Moreover, the internal and external communication of the furnace may be accomplished through wired and or wireless communications, including known communication protocols, Wi-Fi, 802.11(x), Bluetooth, to name just a few.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims. For example, certain embodiments disclosed here envisage usage with a powered fan rather than an inducer fan, or no fan at all. Moreover, the rotating equipment (e.g., motors) and valves disclosed herein are envisaged as being operable at specified speeds or variable speeds through inverter circuitry, for example. Moreover, the internal and external communication of the furnace may be accomplished through wired and or wireless communications, including known communication protocols, Wi-Fi, 802.11(x), Bluetooth, to name just a few.

What is claimed is:

1. A heating, ventilation, and air conditioning (HVAC) system for operation with a refrigerant, comprising:

a thermal storage tank storing thermal media;

a hot water tank storing water; and a refrigerant circuit comprising:

a first heat exchanger located in or in communication with a conditioned environment;

a second heat exchanger located in or in communication with a non-conditioned environment, the second heat exchanger in fluid communication with the first heat exchanger via the refrigerant circuit;

a plurality of thermal storage tank bypass valves configurable to:

selectively route the refrigerant in the refrigerant circuit through a thermal storage tank heat exchanger to exchange thermal energy with the thermal media in a coolant charging mode and a coolant discharging mode, or selectively bypass the thermal storage tank heat exchanger in a coolant holding mode;

a plurality of water tank bypass valves configurable to:

selectively route the refrigerant through a water tank heat exchanger to exchange thermal energy with the water in a heater charging mode or and a heater discharging mode, or selectively bypass the water tank heat exchanger in a heater holding mode; and a four-way valve configurable to route the refrigerant through the refrigerant circuit in a first direction when in a cooling mode and in a second direction, opposite the first direction, when in a heating mode, wherein the thermal storage tank and the hot water tank are connected in series in the refrigerant circuit with the first heat exchanger and the second heat exchanger, and wherein the plurality of water tank bypass valves is configurable to selectively route the refrigerant through or bypass the water tank heat exchanger in both the first and second directions.

2. The HVAC system of claim 1, further comprising a hot water valve connected to the first heat exchanger, the second heat exchanger, and the hot water tank, the hot water valve configurable to selectively route water to the first heat exchanger or the second heat exchanger from the hot water tank to defrost the first heat exchanger or the second heat exchanger.

3. The HVAC system of claim 1, wherein the refrigerant extracts thermal energy from one or both of the non-conditioned environment via the second heat exchanger and the water via the water tank heat exchanger.

4. The HVAC system of claim 1, wherein the refrigerant expels thermal energy to one or both of the non-conditioned environment via the second heat exchanger and the water via the water tank heat exchanger.

5. The HVAC system of claim 1, wherein the refrigerant extracts thermal energy from one or both of the conditioned environment via the first heat exchanger and the thermal media via the thermal storage tank heat exchanger.

6. The HVAC system of claim 1, wherein the refrigerant expels thermal energy to one or both of the conditioned environment via the first heat exchanger and the thermal media via the thermal storage tank heat exchanger.

7. A heating, ventilation, and air conditioning (HVAC) system for use with a refrigerant, comprising:

a compressor, an outdoor heat exchanger, an indoor heat exchanger, an expansion device, and a four-way valve connected together as a refrigerant circuit, wherein the four-way valve is configurable to route the refrigerant through the expansion device in a first direction in a cooling mode and in a second direction, opposite the first direction, in a heating mode; and a thermal energy reservoir connected to the refrigerant circuit in series with the outdoor heat exchanger, the indoor heat exchanger, and the expansion device by a first bypass valve and a second bypass valve, wherein the first bypass valve and the second bypass valve are configurable to:

selectively route the refrigerant through a reservoir heat exchanger in the thermal energy reservoir when the thermal energy reservoir is in a charging mode and a discharging mode to exchange thermal energy with thermal storage media; and selectively disconnect fluid communication between the refrigerant circuit and the reservoir heat exchanger when the thermal energy reservoir is in a holding mode.

8. The HVAC system of claim 7, further comprising a second thermal energy reservoir connected to the refrigerant circuit by a third bypass valve and a fourth bypass valve, wherein the third bypass valve and the fourth bypass valve are configurable to selectively route the refrigerant through a second reservoir heat exchanger in the second thermal energy reservoir to exchange thermal energy with a second thermal storage media when the second thermal energy reservoir is in a second charging mode, and the third bypass valve and the fourth bypass valve are configurable to disconnect fluid communication between the refrigerant circuit and the second reservoir heat exchanger when the second thermal energy reservoir is in a second holding mode.

9. The HVAC system of claim 7, further comprising a second thermal energy reservoir connected to the refrigerant circuit by a third bypass valve and a fourth bypass valve, wherein the third bypass valve and the fourth bypass valve are configurable to selectively route the refrigerant through a second reservoir heat exchanger in the second thermal energy reservoir to exchange thermal energy with a second thermal storage media of a same type as the thermal storage media when the second thermal energy reservoir is in a second charging mode, and the third bypass valve and the fourth bypass valve are configurable to disconnect fluid communication between the refrigerant circuit and the second reservoir heat exchanger when the second thermal energy reservoir is in a second holding mode, wherein the thermal energy reservoir is disposed in series with the second thermal energy reservoir in the refrigerant circuit.

10. The HVAC system of claim 7, further comprising a second thermal energy reservoir connected to the refrigerant circuit by a third bypass valve and a fourth bypass valve, wherein the third bypass valve and the fourth bypass valve are configurable to selectively route the refrigerant through a second reservoir heat exchanger in the second thermal energy reservoir to exchange thermal energy with a second thermal storage media of a same type as the thermal storage media when in a second charging mode, and the third bypass valve and the fourth bypass valve are configurable to disconnect fluid communication between the refrigerant circuit and the second reservoir heat exchanger when the second thermal energy reservoir is in a second holding mode, wherein the thermal energy reservoir is disposed in parallel with the second thermal energy reservoir in the refrigerant circuit to serve a different environment than the second thermal energy reservoir.

11. The HVAC system of claim 7, further comprising a hot water valve connected to the indoor heat exchanger, the outdoor heat exchanger, and the thermal energy reservoir and configurable to selectively route hot water to the indoor heat exchanger or the outdoor heat exchanger from the thermal energy reservoir to defrost the indoor heat exchanger or the outdoor heat exchanger in response to detecting ice formation conditions at the indoor heat exchanger or the outdoor heat exchanger.

12. The HVAC system of claim 7, further comprising a second indoor heat exchanger connected in the refrigerant circuit.

13. The HVAC system of claim 7, further comprising a second outdoor heat exchanger connected in the refrigerant circuit.

14. The HVAC system of claim 7, further comprising a controller configured to operate the compressor and configure valves included in the refrigerant circuit to selectively flow refrigerant through the thermal energy reservoir to place the thermal energy reservoir in the charging mode by exchanging thermal energy with thermal storage media and selectively bypass refrigerant around the thermal energy reservoir to place the thermal energy reservoir into the holding mode based at least one of: a historic heating/cooling demand curve, a temperature of a temperature holding material in the thermal energy reservoir, an energy availability characteristic, or an icing status of the indoor heat exchanger and the outdoor heat exchanger.

15. A controller for a heating, ventilation, and air conditioning (HVAC) system, comprising:

a processor; and a memory storing instructions, that when executed by the processor perform operations comprising:

setting a four-way valve to route a refrigerant through a refrigerant circuit comprising a hot heat exchanger and a cold heat exchanger in a first direction when the HVAC system is operating in a cooling mode or in a second direction, opposite to the first direction, when the HVAC system is operating in a heating mode;

setting bypass valves in the refrigerant circuit based on a temperature of a temperature holding material in a thermal energy reservoir selectively connected with the hot heat exchanger and the cold heat exchanger in series and an operating mode of the thermal energy reservoir, wherein the bypass valves selectively route the refrigerant through the thermal energy reservoir to transfer thermal energy between the refrigerant and the temperature holding material in a charging mode and a discharging mode and selectively bypass the thermal energy reservoir in a holding mode in both the cooling mode and heating mode.

16. The controller of claim 15, the operations further comprising setting defrost valves to route at least one of heated air from a-the hot heat exchanger to a-the cold heat exchanger in the refrigerant circuit and heated temperature holding material from the thermal energy reservoir to the cold heat exchanger.

17. The controller of claim 15, wherein setting the bypass valves comprises setting the bypass valves to route the refrigerant cooled by the hot heat exchanger to the thermal energy reservoir and to bypass the cold heat exchanger to cool the temperature holding material held by the thermal energy reservoir instead of cooling a conditioned environment via the cold heat exchanger when the HVAC system is in the cooling mode and a temperature in a conditioned environment is at or below an activation temperature for cooling the conditioned environment.

18. The controller of claim 15, wherein setting the bypass valves comprises setting the bypass valves to route the refrigerant cooled by the hot heat exchanger to the thermal energy reservoir and to the cold heat exchanger to further cool the refrigerant by expelling thermal energy to the temperature holding material before routing the refrigerant to the cold heat exchanger to cool a conditioned environment via the cold heat exchanger when the HVAC system is in the cooling mode and a temperature in a conditioned environment is at or above an activation temperature for cooling the conditioned environment.

19. The controller of claim 15, wherein setting the bypass valves comprises setting the bypass valves to route the refrigerant heated by the cold heat exchanger to the thermal energy reservoir and to the hot heat exchanger to further heat the refrigerant by extracting thermal energy from the temperature holding material before routing the refrigerant to the hot heat exchanger to heat a conditioned environment via the hot heat exchanger when the HVAC system is in the heating mode and a temperature in a conditioned environment is at or below an activation temperature for heating the conditioned environment.

20. The controller of claim 15, wherein setting the bypass valves comprises setting the bypass valves to route the refrigerant heated by the cold heat exchanger to the thermal energy reservoir and to bypass the hot heat exchanger to heat the temperature holding material held by the thermal energy reservoir instead of heating a conditioned environment via the hot heat exchanger when the HVAC system is in the heating mode and a temperature in a conditioned environment is at or above an activation temperature for heating the conditioned environment.

* * * * *